US011814196B2

(12) United States Patent
Huth et al.

(10) Patent No.: US 11,814,196 B2
(45) Date of Patent: Nov. 14, 2023

(54) PRESSURE-TIGHT STORAGE VESSEL CONTAINING A LIQUID

(71) Applicant: EUROIMMUN Medizinische Labordiagnostika AG, Luebeck (DE)

(72) Inventors: Bianca Huth, Dassow (DE); Alexander Kowtun, Ziethen (DE); Lars Koschinat, Ratekau-Warnsdorf (DE); Frank Mollenhauer, Ziethen (DE); Winfried Stoecker, Gross Groenau (DE)

(73) Assignee: EUROIMMUN Medizinische Labordiagnostika AG, Luebeck (DE)

( * ) Notice: Subject to any disclaimer, the term of this patent is extended or adjusted under 35 U.S.C. 154(b) by 736 days.

(21) Appl. No.: 16/718,547

(22) Filed: Dec. 18, 2019

(65) Prior Publication Data

US 2020/0198813 A1 Jun. 25, 2020

(30) Foreign Application Priority Data

Dec. 21, 2018 (EP) ..... 18215204

(51) Int. Cl.
*B01L 3/00* (2006.01)
*B65B 1/16* (2006.01)

(52) U.S. Cl.
CPC ..... *B65B 1/16* (2013.01); *B01L 3/508* (2013.01); *B01L 2200/12* (2013.01);
(Continued)

(58) Field of Classification Search
CPC ..... B01L 3/50; B01L 3/5021; B01L 3/5082; B01L 3/523; B01L 2300/044;
(Continued)

(56) References Cited

U.S. PATENT DOCUMENTS 4,890,757 A 1/1990 Robbins, III
5,560,830 A * 10/1996 Coleman ..... B01D 21/262 210/695

(Continued)

FOREIGN PATENT DOCUMENTS

CN 102113887 7/2011
CN 102282078 12/2011

(Continued)

OTHER PUBLICATIONS

Written Opinion and Search Report dated Aug. 24, 2020 in Singaporean Application No. 10201912830Y, 9 pages.

(Continued)

*Primary Examiner* — Jill A Warden
*Assistant Examiner* — Dwayne K Handy
(74) *Attorney, Agent, or Firm* — Grüneberg and Myers PLLC

(57) ABSTRACT

A pressure-tight storage vessel contains a liquid, has an elongated main body rotationally symmetrical with respect to an axis of symmetry, and forms, at least partially, a rotationally symmetrical hollow space in which the liquid is substantially received, wherein the main body is terminated at its bottom side by a base. Furthermore, at its top side, the storage vessel has an opening which is closed off in a pressure-tight manner by a closure, has a plurality of reinforcement elements, which bears against the main body at the outside, which extends parallel to the axis of symmetry of the main body, and arranged rotationally symmetrically about the axis of symmetry of the main body. In each case between adjacent reinforcement elements, respective externally exposed wall sections of the main body are formed, and the composition of the exposed wall sections permits a pressure-tight insertion by at least two hollow needles.

17 Claims, 20 Drawing Sheets

(52) U.S. Cl.
CPC ..... *B01L 2300/044* (2013.01); *B01L 2300/06* (2013.01); *B01L 2300/0832* (2013.01); *B01L 2300/0848* (2013.01); *B01L 2300/12* (2013.01)

(58) Field of Classification Search
CPC ..... B01L 2300/0832; B01L 2300/0848; B01L 2300/0858
See application file for complete search history.

(56) References Cited

U.S. PATENT DOCUMENTS

| | | | | |
|---|---|---|---|---|
| 2001/0005780 | A1 | 6/2001 | Jonsson | |
| 2004/0022696 | A1* | 2/2004 | Zigler | G01N 35/1079 422/159 |
| 2010/0288060 | A1* | 11/2010 | Ronsick | G01N 35/0099 73/864.63 |
| 2012/0048827 | A1 | 3/2012 | Levin | |
| 2013/0064739 | A1* | 3/2013 | Koskinen | B01L 3/50853 422/554 |
| 2013/0109009 | A1 | 5/2013 | Kessel | |
| 2014/0124510 | A1 | 5/2014 | Bernay et al. | |
| 2016/0121324 | A1 | 5/2016 | Koch | |
| 2017/0128945 | A1 | 5/2017 | Stoecker et al. | |
| 2017/0176303 | A1 | 6/2017 | Stoecker et al. | |

FOREIGN PATENT DOCUMENTS

| | | |
|---|---|---|
| CN | 206315840 U | 7/2017 |
| JP | 2009-222443 | 10/2009 |
| TW | 200526190 | 8/2005 |
| WO | 2014/195409 | 12/2014 |
| WO | 2015/197176 | 12/2015 |

OTHER PUBLICATIONS

European Search Report dated Apr. 4, 2019 in European Application No. 18215204.1 with partial English translation, 11 pages.

* cited by examiner

Detail Z

PRESSURE-TIGHT STORAGE VESSEL CONTAINING A LIQUID

CROSS-REFERENCE TO RELATED APPLICATION

The present application claims the benefit to the European application EP 18215204.1, filed on Dec. 21, 2018, which is incorporated by reference in its entirety.

BACKGROUND OF THE INVENTION

Field of the Invention

The present invention relates to a pressure-tight storage vessel containing a liquid, and furthermore having an elongated main body which is rotationally symmetrical with respect to an axis of symmetry and which forms, at least sectionally or at least partially, a rotationally symmetrical hollow space in which the liquid is substantially received, or the greatest part thereof is received, wherein the main body is terminated at its bottom side by a base and furthermore, at its top side, has an opening which is closed off in a pressure-tight manner by a closure, furthermore having a plurality of reinforcement elements which bear against the main body at the outside and which extend parallel to the axis of symmetry of the main body, in particular in the longitudinal direction of the main body, and which are arranged rotationally symmetrically about the axis of symmetry of the main body such that, in each case between adjacent reinforcement elements, respective externally exposed wall sections of the main body are formed, and wherein the composition of the exposed wall sections permits a pressure-tight insertion by at least two hollow needles. The hollow space is preferably a circular-cylindrical or conical-cylindrical hollow space.

The invention also relates to a method for transferring a liquid from a storage vessel into a reaction vessel, comprising the steps of providing a storage vessel according to the invention, inserting in a pressure-tight manner a first hollow needle, which is connected to a flushing liquid reservoir, and inserting in a pressure-tight manner a second hollow needle, which is connected to the reaction vessel, and also introducing flushing liquid via the first hollow needle from the flushing liquid reservoir into the storage vessel, with expulsion of the liquid via the second hollow needle from the storage vessel into the reaction vessel.

DISCUSSION OF THE BACKGROUND

For numerous technical processes from the fields of chemistry, biotechnology, pharmacy and medicine, it is necessary for use to be made of multiple liquid reagents which in each case are able to be produced or able to be filled only with great effort. It is then expedient not to produce each of them anew for each run-through of the process, but rather to prepare in one pass a quantity sufficient for multiple run-throughs, which quantity can then be stored in suitable portions until use.

Apart from economical and logistical advantages, this leads, particularly in the field of medicine, or more precisely laboratory diagnostics, to minimization of susceptibility to faults of the overall system, since, for each run-through of the desired diagnostic process, it is possible to use practically identical reagents. If a result is ambiguous, it is then easy to check whether a lack of quality of the reagents used was the cause for this ambiguity.

However, the trend towards miniaturization in the field of analytics and diagnostics makes more difficult the reduction of reaction mixtures to the absolutely necessary minimum volume, for saving the frequently high-priced reagents, and the portioning, particularly if the individual portion has a low volume and, in extreme cases, comprises only a few microlitres. The smaller the volume, the greater the relative loss with the transfer of the liquid phase from one container to the other one due to non-specific adsorption to surfaces and due to dead volumes inherent in each device.

The transfer of small volumes often also entails lower reproducibility of the process, since random effects such as differing evaporation owing to temperature differences, vibrations or technically related variations in the quantities used have a stronger effect on the result.

A particular problem is presented by inhomogeneous liquids, for example suspensions of beads in aqueous solution, the density of which is higher than that of water, with the result that the beads can sink to the bottom. If such an aqueous solution is mixed up to homogeneity and subsequently portioned, then the proportion of the beads in the aqueous phase is reduced during the portioning until all the beads are sedimented. Accordingly, the number of beads per portion drops, and portions filled at the beginning of the portioning have a larger quantity of beads than those filled at a later stage.

Additionally, such beads in a liquid phase easily attach to surfaces, for example below the lid of the storage vessel. This also makes more difficult the removal of portions having the same concentration of beads, in particular during automated processes in which the position of the beads within the transport vessel and the full transfer thereof is not checked visually.

For numerous miniaturized systems, use is made of beads as carriers for reagents. For example, in the field of immunodiagnostics, they may be carriers for immobilized antigens, to which antibodies to be detected in human samples bind. If such beads are incubated with a liquid sample, then, in the presence of antibodies, the formation of the antigen-antibody complex, which is immobilized on the bead, occurs. After a washing step, said complex can be detected using suitable reagents, for example a marked secondary antibody. The commercially available random access analysers are based on this principle. The beads are conventionally delivered in aqueous solutions and stored until use.

Known from WO2015/197176 of the applicant is the principle of introducing flushing liquid from a flushing liquid reservoir into a pressure-tight storage vessel by means of a first hollow needle, which storage vessel contains a liquid which is to be transferred into a reagent vessel. By inserting a second hollow needle into the storage vessel, the liquid stored in the storage vessel is then flushed out of the storage vessel through the second hollow needle, inserted into the storage vessel, by means of introduction of the flushing liquid, preferably subjected to pressure, wherein the second hollow needle is connected to the reaction vessel.

SUMMARY OF THE INVENTION

It is an object of the invention to make possible or to provide a particularly simple automated system for quantitative, that is to say the most complete possible, transfer of a small volume of liquid from a storage vessel into a reaction vessel.

The object underlying the invention is achieved by the subject matter of following various embodiments.

1. Pressure-tight storage vessel (V) containing a liquid (FL), having an elongate main body (G) which is rotationally symmetrical with respect to an axis of symmetry (SA) and which forms, at least sectionally, a rotationally symmetrical hollow space (H), in particular a circular-cylindrical or conical-cylindrical hollow space (H), in which the liquid (FL) is substantially received.

wherein the main body (G) is terminated at its bottom side (U) by a base (B) and furthermore, at its top side (O), has an opening (OF) which is closed off in a pressure-tight manner by a closure (VS), furthermore having a plurality of reinforcement elements (VE) which bear against the main body (G) at the outside and which extend parallel to the axis of symmetry (SA) of the main body (G) and which are arranged rotationally symmetrically about the axis of symmetry (SA) of the main body (G) such that, in each case between adjacent reinforcement elements (VE), respective externally exposed wall sections (W) of the main body (G) are formed.

and wherein the composition of the exposed wall sections (W) permits a pressure-tight insertion by at least two hollow needles (N1, N2), 2. Storage vessel according to embodiment 1, wherein furthermore the main body (G) and the reinforcement elements (VE) are produced in one piece, preferably by means of an injection moulding process or a 3D printing process.

3. Storage vessel according to embodiment 1, wherein the respective exposed wall sections (W) have a respective equal wall thickness (WS).

4. Storage vessel according to embodiment 2, wherein the main body (G) and the reinforcement elements (VE) are produced in one piece from plastic, preferably from polyethylene, particularly preferably high-density polyethylene, by means of an injection moulding process.

5. Storage vessel according to embodiment 4, wherein the main body (G) has no separating seam and no sprue residues on the exposed wall sections (W) for the insertion of the needles (N1, N2).

6. Storage vessel according to embodiment 1, wherein the base (B) is curved from the lowest point (TP) of the base (B) towards the inner wall (I) of the main body (G).

7. Storage vessel according to embodiment 1, wherein, at its inner side (IS), the main body (G) has a substantially constant surface roughness, in particular an average roughness depth of less than 0.8 Rz, particularly preferably of less than 0.4 Rz.

8. Storage vessel according to embodiment 4, wherein the main body (G) and the reinforcement elements (VE) are produced in one piece from plastic by means of an injection moulding process 9. Storage vessel according to embodiment 1, wherein the wall thickness (WS) of the exposed wall sections (W) is greater than 0.15 mm, preferably greater than 0.2 mm.

10. Storage vessel according to embodiment 1, wherein the storage vessel (V) has at its top side (O) a border (UR) which encircles the opening (OF) of the main body (G) and which is spaced apart from the outer boundary (R) of the opening (OF).

11. Storage vessel according to embodiment 1, wherein the liquid (FL) constitutes an inhomogeneous liquid phase, preferably an aqueous solution comprising beads.

12. Storage vessel according to embodiment 1, wherein the liquid (FL) constitutes a homogeneous liquid phase, preferably comprising a biological or chemical agent in aqueous solution, or a liquid sample, particularly preferably a blood sample, most preferably serum.

13. Storage vessel according to embodiment 1, wherein the reinforcement elements and the main body extend as far as the bottom side of the storage vessel, with the result that the reinforcement elements form, together with the main body, guide grooves, which are open towards the bottom side of the main body.

14. Storage vessel according to embodiment 11, wherein the storage vessel has at its top side a shoulder which delimits the guide grooves towards the top.

15. Storage vessel according to embodiment 1, wherein the main body (G) forms, at least sectionally or at least partially, a circular-cylindrical hollow space or a conical-cylindrical hollow space.

16. Magazine (M) for storing multiple storage vessels, having at least one storage vessel according to one of embodiments 1 to 15.

17. Magazine (M) for storing multiple storage vessels according to embodiment 16, having at least one storage vessel according to embodiment 13, wherein the magazine has at least one magazine channel (MK) which extends from a top side of the magazine (OM) as far as a bottom side of the magazine (UM) and into which the storage device can be pushed, with its bottom side (U) first, from the top or the top side of the magazine (OM), wherein, in a lower region of the magazine channel (MK), provision is made of a mechanically flexible retaining element, which, in a rest position, projects into the magazine channel and which is furthermore formed such that, in a first position of the storage vessel, it engages into one of the guide grooves and also the shoulder of the storage vessel comes to bear against the retaining element.

18. Magazine for storing multiple storage vessels according to embodiment 17, wherein, in the lower region of the magazine channel (MK), provision is made of a mechanically flexible guide element (FE), which, at least in a second position of the storage vessel below the first position, engages into one of the guide grooves (FR) and bears against the reinforcement elements (VE) forming the guide groove, wherein, in the second position, the storage vessel projects with its bottom side (U) from the magazine channel (MK).

19. Method for transferring a liquid (FL) from a storage vessel (V) into a reaction vessel (RG), comprising the steps of a) providing the storage vessel (V) according to one of embodiments 1 to 15, b) inserting in a pressure-tight manner a first hollow needle (N1), which is connected to a flushing liquid reservoir (SR), and c) inserting in a pressure-tight manner a second hollow needle (N2), which is connected to the reaction vessel (RG), d) introducing flushing liquid (SF) via the first hollow needle (N1) from the flushing liquid reservoir (SR) into the storage vessel (VG), with expulsion of the liquid (FL) via the second hollow needle (N2) from the storage vessel (V) into the reaction vessel (RF).

DETAILED DESCRIPTION OF THE INVENTION

Figure 1:
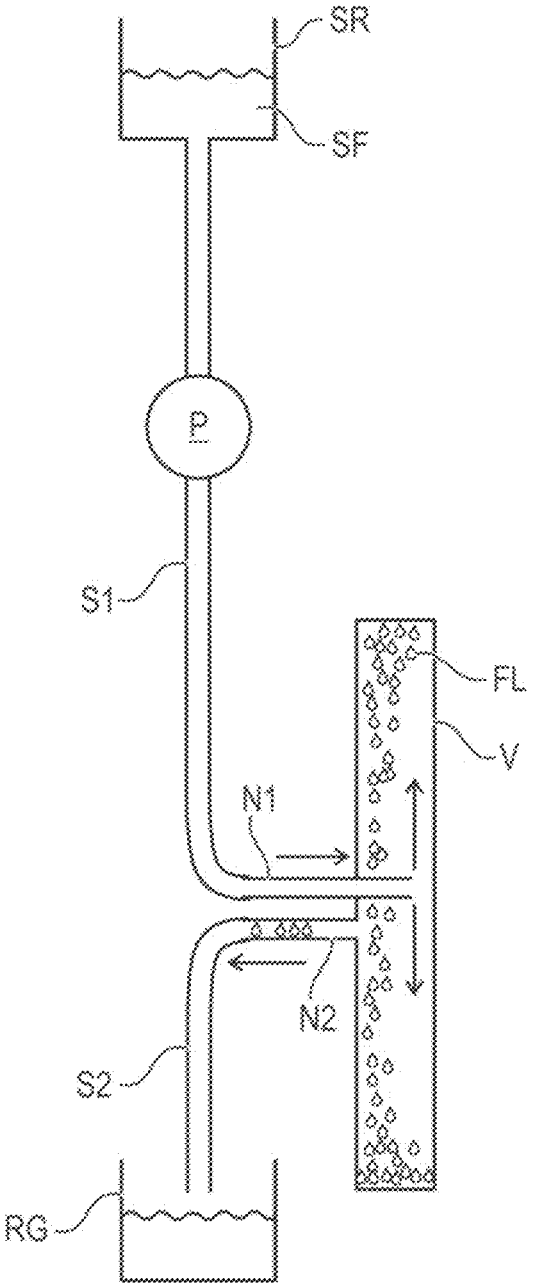
FIG. 1 Prior art
FIG. 1 shows a basic principle for flushing a liquid out of a storage vessel, as is known from the related art.

The object according to the invention is achieved by the storage vessel according to the invention, the magazine according to the invention having a storage vessel according to the invention, and the method according to the invention.

What is proposed is a pressure-tight storage vessel containing a liquid, and having an elongated main body which is rotationally symmetrical with respect to an axis of symmetry, which forms, at least partially or sectionally, a rotationally symmetrical hollow space in which the liquid is substantially received, or the greatest part thereof is received. The hollow space is preferably a circular-cylindrical or conical-cylindrical hollow space. The main body is terminated at its bottom side by a base and furthermore, at its top side, has an opening which is closed off in a pressure-tight manner by a closure. Said main body furthermore has a plurality of reinforcement elements which bear against the main body at the outside and which extend parallel to the axis of symmetry of the main body and which are arranged rotationally symmetrically about the axis of symmetry of the main body such that, in each case between adjacent reinforcement elements, respective externally exposed wall sections of the main body are formed, and wherein the composition of the exposed wall sections permits a pressure-tight insertion by at least two hollow needles. The reinforcement elements are preferably elongated ribs having a material thickness which is greater than a wall thickness or material thickness of the wall sections at least by a factor of 2.

Preferably, the storage vessel is vapour-tight, water-tight and, at an inner pressure of up to 2 bar, pressure-tight. Preferably, the composition of the exposed wall sections permits pressure-tight insertion by at least two hollow needles in a manner in which, when the hollow needles are inserted, the insertion points are pressure-tight in a manner in which no liquid exits between the wall sections and the hollow needles if an inner pressure of up to 2 bar prevails in the capillary.

The main body is preferably rotationally symmetrical with respect to the axis of symmetry of the main body in the longitudinal direction.

The reinforcement elements are arranged in particular rotationally symmetrically with respect to the axis of symmetry of the main body and also point-symmetrically with respect to the axis centre point of the axis of symmetry of the main body. The axis of symmetry of the main body preferably extends in the longitudinal direction of the main body.

In particular, the reinforcement elements are elongate, preferably in the longitudinal direction of the storage vessel. The reinforcement elements are preferably so-called ribs, which bear against the main body at the outside. The reinforcement elements are preferably elongated ribs having a material thickness which is greater than a wall thickness or material thickness of the wall sections at least by a factor of 2.

Preferably, the reinforcement elements have a length which is at least 70% of the length of the main body.

The reinforcement elements are preferably arranged rotationally symmetrically with respect to the axis of symmetry in relation to one or more rotations of the capillary about the axis of rotation through a defined angle, wherein the defined angle is in particular 360° divided by the number of reinforcement elements. In other words: the storage vessel is substantially rotationally symmetrical in relation to a rotation of the storage vessel about the axis of symmetry of the storage vessel through a defined angle, which angle is in particular 360° divided by the number of reinforcement elements. The storage vessel is specifically in particular rotationally symmetrical about the axis of symmetry of the storage vessel in the longitudinal direction.

The fact that the reinforcement elements are, in one of the aforementioned manners, arranged rotationally symmetrically about the axis of symmetry of the main body means that it is made possible for the storage vessel to be able to be gripped from the outside by way of one or more grip elements for the purpose of automated processing, wherein the storage vessel fits into such a gripping system not only in a single defined position but in a plurality of positions. For example, with the use of four reinforcement elements and thus four different rotational positions about the axis of symmetry of the main body or the axis of symmetry of the storage vessel, for the purpose of automation, it is unimportant which of these four positions the storage vessel assumes. In other words: if a storage vessel according to the invention is provided in an automation step and if said storage vessel is to be fed to a gripping system, in order that the gripping system is then to grip the storage vessel and furthermore, for example for a step of inserting hollow needles, is to hold said storage vessel firmly, it is then not necessary, by way of a previously occurring sorting step, or provision step, for the storage device in the course of the automation, for attention to be paid regarding in which of the multiple defined positions the storage vessel is fed or presented to the gripper.

The fact that, furthermore, between adjacent reinforcement elements, respective externally exposed wall sections of the main body are formed means that specifically the desired insertion of the hollow needles into said exposed wall sections can be realized, so that dimensioning of the wall sections with regard to the wall thickness thereof can be realized such that the wall thickness or the wall is sufficiently easy to penetrate for the hollow needles. However, the entire mechanical stability of the storage device does not need to be brought about by dimensioning of said wall sections or of the wall thickness alone, but rather can specifically be ensured by dimensioning of the reinforcement elements. It is thus possible to minimize expenditure of force for the insertion of a hollow needle through a wall section without excessively reducing the overall mechanical stability or robustness of the storage vessel. It is therefore then possible to ensure a mechanical stability of the storage vessel, in particular with regard to forces occurring during a gripping process by a gripper, by dimensioning of the reinforcement elements.

The fact that the reinforcement elements are situated on the main body at the outside means that it is furthermore possible for provision to be made of the hollow space for receiving the liquid without formation of additional mechanical elements situated in the hollow space, such as for example support elements extending through the hollow space. If such a support element were to be provided within the hollow space, then such a mechanical element would in turn impede a throughflow of the hollow space by the flushing liquid and thus reduce in terms of its effectiveness an expulsion of the liquid, it would therefore be possible that residual volumes of the liquid remain in the storage vessel, which is undesirable.

Preferably, the main body and the reinforcement elements of the storage vessel are produced in one piece, in particular by means of an injection moulding process or a 3D printing process. This yields the advantage that it is possible to ensure a homogeneity of the material for the stability of the storage vessel.

Preferably, the respective exposed wall sections have a respective equal wall thickness. Particularly preferably, the respective exposed wall sections have a respective equal and constant wall thickness in the direction of longitudinal extent of the main body. This yields the advantage that a mechanical behaviour or a force behaviour during insertion of one or more hollow needles into a corresponding wall section is identical for all the wall sections, with the result that a processing step for the insertion of a hollow needle into a wall section is independent of a rotation of the storage vessel about the axis of symmetry of the vessel for defined preferred positions. Such preferred positions emerge as those positions which are present with consideration taken of the corresponding angles as described above.

Preferably, the main body and the reinforcement elements of the storage vessel are produced in one piece from plastic, preferably from polyethylene, particularly preferably high-density polyethylene, by means of an injection moulding process.

The case in which the plastic is a polyethylene yields the advantage that the wall sections are sufficiently soft for the insertion of one or more hollow needles without the risk of a wall section breaking, or particles being detached from the wall section and introduced into the liquid. In this way, a situation is avoided in which such particles pass into the liquid and possibly even block those hollow needles via which the flushing liquid is to be expelled from the storage vessel. In particular, high-density polyethylene also yields the advantage that this plastic is compatible with the requirements for laboratory use for processing biological samples.

Selecting high-density polyethylene as the plastic yields the particular advantage that such a plastic has particularly high tear resistance and stability and can therefore be produced or processed in very thin thicknesses. This therefore then allows a particular thin or small thickness of a wall section or of the wall sections to be realized, with the result that the wall sections are able to be penetrated even more easily. In particular, polyethylene yields the advantage that this plastic is compatible with the requirements for laboratory use for processing biological samples.

Preferably, the main body has no separating seam and no sprue residues on the exposed wall sections for the insertion of the needles. Such seams or residues are normal material artefacts of an injection moulding process. The fact that such artefacts are not present on the exposed wall sections means that a homogeneity of the material of the wall sections, and thus also a mechanical stability at said wall sections, is realized. It is furthermore possible in this way to ensure that the insertion of hollow needles at the wall sections can be realized with an expenditure of force which is not dependent on whether a wall section has a corresponding material artefact from an injection moulding process. In this way, particularly high reproducibility of the insertion behaviour, or of a force to be expended, for an insertion of a hollow needle at a wall section can be made possible.

Preferably, the base is curved from the lowest point of the base towards the inner wall of the main body. Particularly preferably, the base is upwardly curved from the lowest point of the base towards the inner wall of the main body.

The fact that, when flushing out the liquid, particles or beads possibly contained in the liquid are to be flushed out along therewith means that it is necessary to avoid such particles being caught in a boundary region of the base. By way of one of the configurations stated here of the base in a curved manner, a flow behaviour of the liquid and also of the flushing liquid is facilitated in the region between the base and the inner wall of the main body, with the result that it is less likely that liquid quantities or else particles or beads of a liquid are caught in such a region.

Preferably, at its inner side, the main body has a substantially constant surface roughness, in particular an average roughness depth of less than 0.8 Rz, particularly preferably of less than 0.4 Rz. By way of a surface roughness selected in the manner described here, a flow of particles or beads on the inner side of the main body is improved or facilitated such that it is made less likely that particles or beads of the liquid remain in the storage vessel.

Preferably, the main body has a recess on the bottom side of the base. This yields the advantage that, provision is made in said recess of a position or a location at which, during an injection moulding process, material can be injected or can be introduced into an injection moulding tool. If, at said recess, a material artefact, such as for example a sprue residue, is formed, then said material artefact does not project beyond the bottom side of the base but remains in the recess. In this way, it can be ensured that the bottom side of the base of a first capillary or of a first storage vessel can be placed onto a second capillary or onto the top side of a second capillary, for example during stacking of the storage vessels one on top of the other, without such a material artefact giving rise to or influencing a mechanical stability of this ensemble of storage vessels. Furthermore, the material artefact would also not be able to damage a closure on a top side of the storage vessel situated below.

Preferably, the wall thickness of the exposed wall sections is greater than 0.15 mm, preferably greater than 0.2 mm. Selecting the wall thickness in the manner described here ensures a minimum stability of the wall sections for the insertion of the needles. The wall thickness of the reinforcement elements is preferably at least 0.5 mm, more preferably at least 0.8 mm, most preferably at least 1 mm.

Preferably, the respective wall sections between two reinforcement elements delimiting a respective wall section have a respective equal wall width.

Preferably, the storage vessel has at its top side a border which encircles the opening of the main body and which is spaced apart by a spacing from an outer boundary of the opening. The spacing is preferably at least 0.01 mm in size, particularly preferably 0.05 mm in size. The border is preferably at least 0.2 mm high.

Preferably, the closure of the storage vessel is a film which is attached or fastened to the border by means of a melting process.

The border yields the advantage that it may serve as a shoulder for the film, wherein it is however possible that the boundary is changed in terms of its shape during the melting-on of the film. If the boundary is too wide during the melting process, this can then lead to the boundary being widened in the direction of the axis of symmetry of the storage vessel and being extended in this direction above the outer boundary of the opening of the main body, which can form a so-called undercut which is formed by the material of the boundary that projects above the outer boundary of the opening and the film thereabove. In such an undercut, it is then possible for liquid volumes or else particles or beads of the liquid to be retained during the flushing process. The fact that the outer boundary is preferably spaced apart from the opening means that provision is made for such an undercut not to be formed even during a melting-on process.

Preferably, the liquid constitutes an inhomogeneous liquid phase, preferably an aqueous solution comprising beads.

Preferably, the liquid constitutes a homogeneous liquid phase, preferably comprising a biological or chemical agent in aqueous solution, or a liquid sample, particularly preferably a blood sample, most preferably serum.

The reinforcement elements preferably have a material thickness which is at least twice as large as the wall thickness of the exposed wall sections. This ensures a mechanical minimum stability of the storage vessel.

Preferably, the reinforcement elements have a material thickness which is at most four times as large as the wall thickness of the exposed wall sections. This is advantageous in the case of an injection moulding process for joint production in one piece of the main body and the reinforcement elements, since, with excessively large differences in the material thicknesses, a flow of the plastic material in the mould or in the injection moulding tool cannot otherwise be reliably achieved for all the volume regions within the tool or within the mould.

A method for transferring a liquid from a storage vessel into a reaction vessel is also proposed, which method comprises the steps of a) providing a storage vessel according to the invention,
b) inserting in a pressure-tight manner a first hollow needle, which is connected to a flushing liquid reservoir,
c) inserting in a pressure-tight manner a second hollow needle, which is connected to the reaction vessel, and
d) introducing flushing liquid via the first hollow needle from the flushing liquid reservoir into the storage vessel, with expulsion of the liquid via the second hollow needle from the storage vessel into the reaction vessel.

In a preferred embodiment of all the aspects and embodiments, the liquid constitutes an inhomogeneous liquid phase, preferably an aqueous solution comprising solids such as particles or beads.

Preferably, the term "inhomogeneous liquid phase" means that the liquid phase, in addition to a liquid main constituent, has at least one further constituent in a phase which is separate therefrom, for example a further liquid which does not mix with the liquid main constituent, or a solid.

In a preferred embodiment of all the aspects and embodiments, the liquid constitutes a homogeneous liquid phase, preferably comprising a biological or chemical agent in aqueous solution, or a liquid sample, particularly preferably a blood sample, most preferably serum. Preferably, the homogeneous liquid phase involves human or animal samples taken for diagnostic testing and optionally processed, for example blood, preferably blood serum, urine, cerebrospinal fluid, saliva or sweat.

In one preferred embodiment, the term "liquid", as used herein, is to be understood as meaning a substance or a substance mixture which, at 20° C. and under atmospheric pressure, consists of a liquid to an extent of at least 10, preferably 20, 30, 40, 50, 75 percent by weight, which may however be inhomogeneous, in particular to the effect that it contains solids. For carrying out the method according to the invention, the liquid is of liquid form, but may also be stored in the storage vessel in a frozen state. The storage vessel is preferably largely filled with liquid, that is to say for example at least 75, 80, 90 or 95% of said storage vessel is filled. The gas phase may consist of air or comprise a chemically inert shielding gas, for example argon or nitrogen. The volume of the storage vessel may be less than 100 μl, more preferably less than 50 μl, even more preferably less than 45 μl, most preferably less than 35 μl. In particular, in one exemplary embodiment, the volume of the storage vessel may be 25 μl.

The liquid may be a solution of biological or chemical agents, or a sample of human or animal origin that contains a reactant to be detected. Particularly preferably, said liquid is a sample comprising a body fluid selected from the group comprising serum, urine, cerebrospinal fluid or saliva, or a dilution or processed form thereof. Alternatively, said liquid may be a sample composed of foodstuffs, beverages, drinking or bathing water, stool, soil material or the like. Preferably, after being obtained, the sample is processed in a suitable manner, in the case of a blood sample for example by centrifugation of the non-soluble constituents of the blood, and/or made preservable.

The liquid may preferably have an inhomogeneous phase and comprise either two liquids which are not miscible or are miscible only to a limited extent or a solid substance in a liquid. In one preferred embodiment, the liquid involves beads in an aqueous solution. Such beads may be provided with biological reagents immobilized thereon, for example in the form of polypeptides functioning as antigens. Available commercially are various beads for numerous applications, largely carbohydrate—(for example agarose-) based or plastic-based beads. Said beads contain active or activatable chemical groups such as carboxyl groups, which can be used for the immobilization of reagents, for example of antibodies or antigens. Preferably, beads having an average diameter of 0.2 μm to 5 mm, 0.5 μm to 1 mm, 0.75 μm to 100 μm or 1 μm to 10 μm are involved. The beads can be coated with an antigen which binds to a diagnostically relevant antibody, or with affinity ligands, for example biotin or glutathione. Preferably, the liquid comprises the beads in the form of an aqueous suspension having a bead content of 10 to 90%, more preferably 20 to 80%, more preferably 30 to 70%, even more preferably 40 to 60% (w/w).

In one particularly preferred embodiment, paramagnetic beads, which can be easily concentrated on a surface with the aid of a magnet, are involved. For this purpose, commercially available paramagnetic beads generally contain a paramagnetic mineral, for example iron oxide.

Irrespective of the homogeneity state, an aqueous liquid phase is preferably involved. For the purpose of conservation, this may contain suitable additives such as ethanol or azide, or stabilizers such as pH buffers, glycerol or salts in physiological concentrations, for example for stabilizing biological or chemical agents. A suitable buffer is for example 10 mM sodium phosphate, 150 mM sodium chloride, 50% glycerol, and 0.02 (w/v) sodium azide. pH 7.4.

Figure 2:
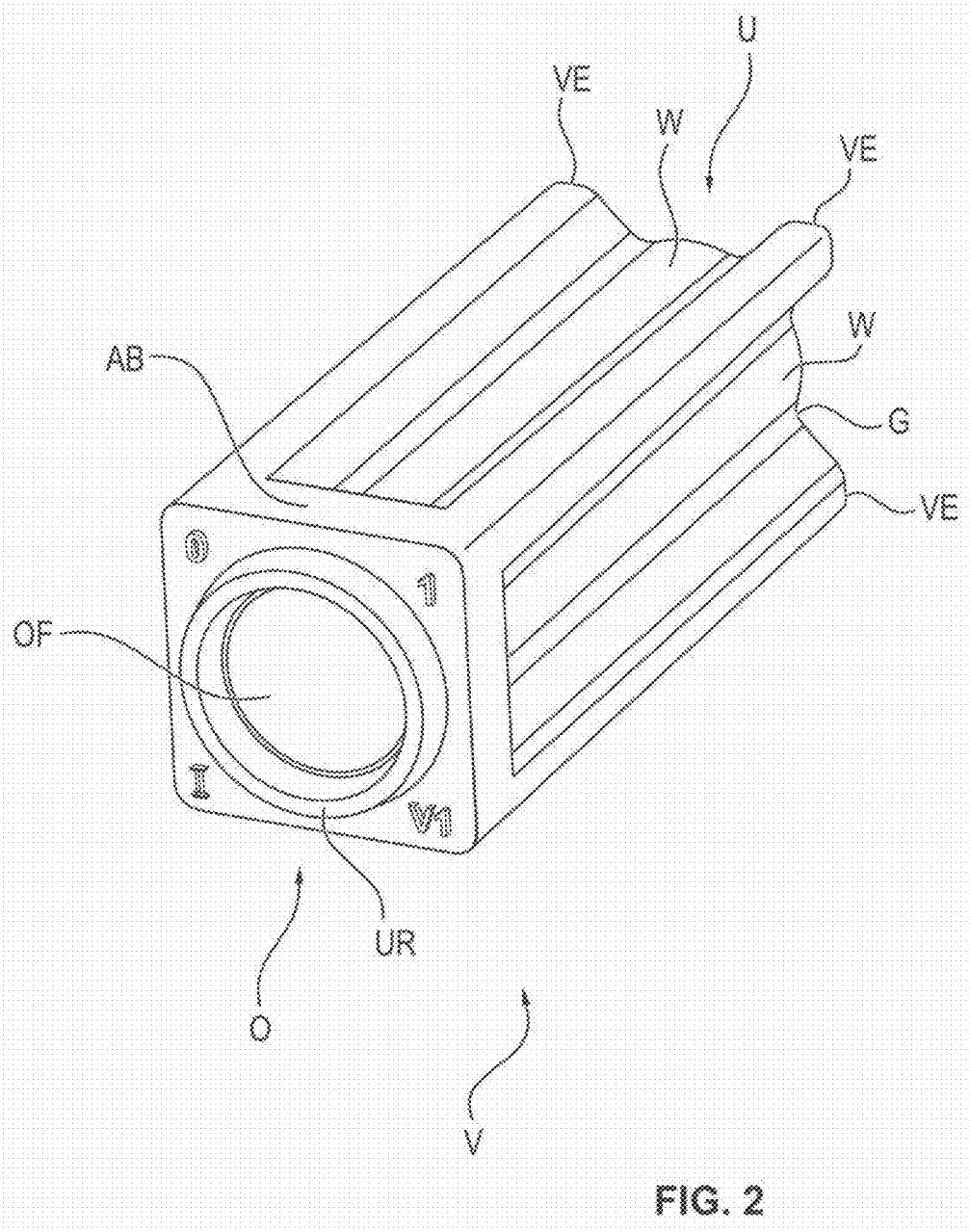
FIG. 2 shows a preferred embodiment of a storage vessel according to the invention in a side position.
Figure 3:
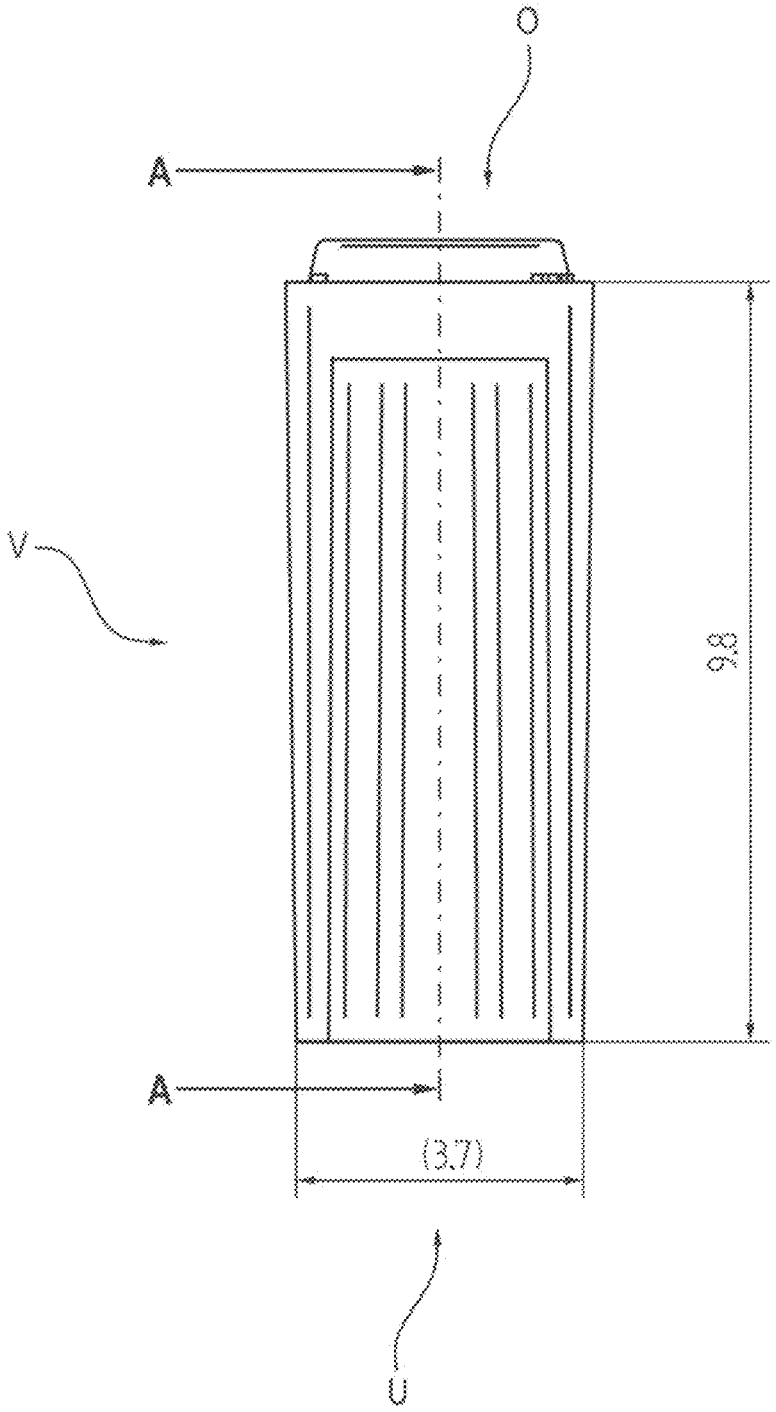
FIG. 3 shows the preferred embodiment of the storage vessel according to the invention in an upright position in a side view.
Figure 4:
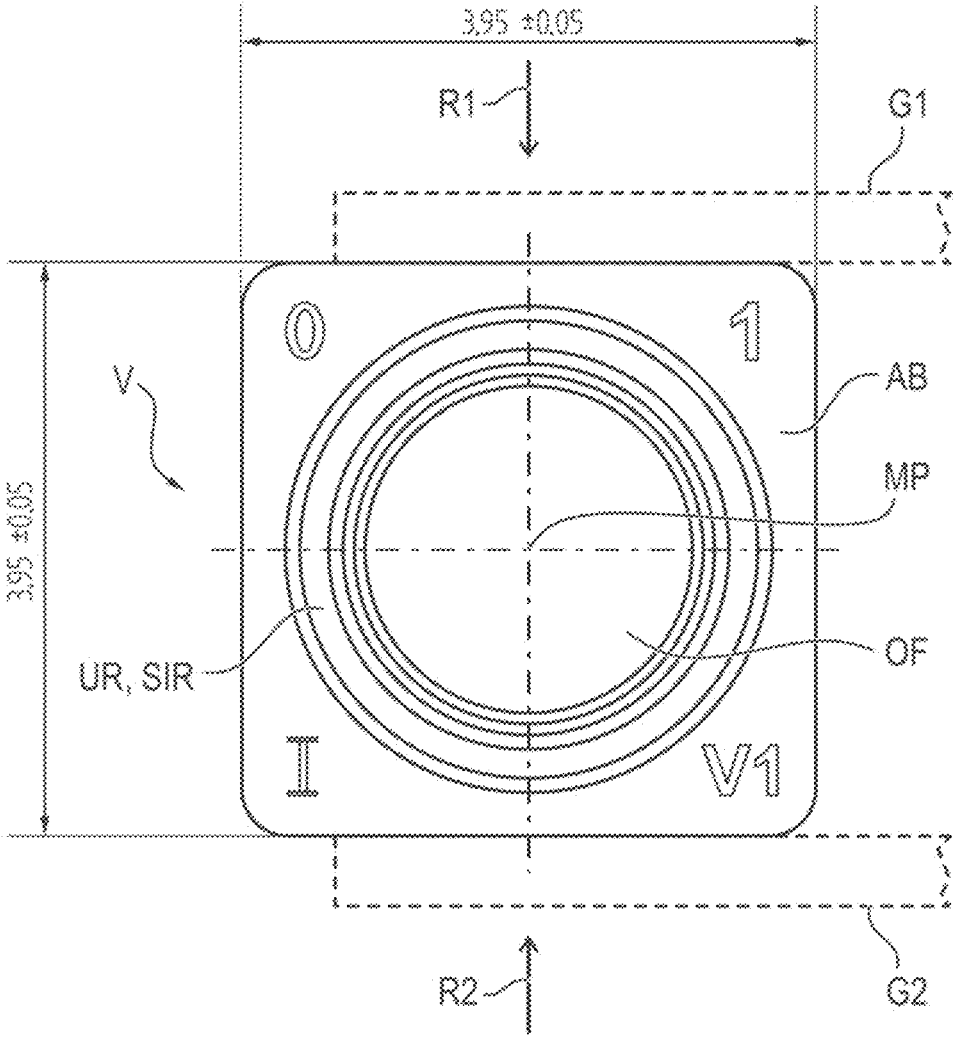
FIG. 4 shows the preferred embodiment of the storage vessel in a top view from above.
Figure 5:
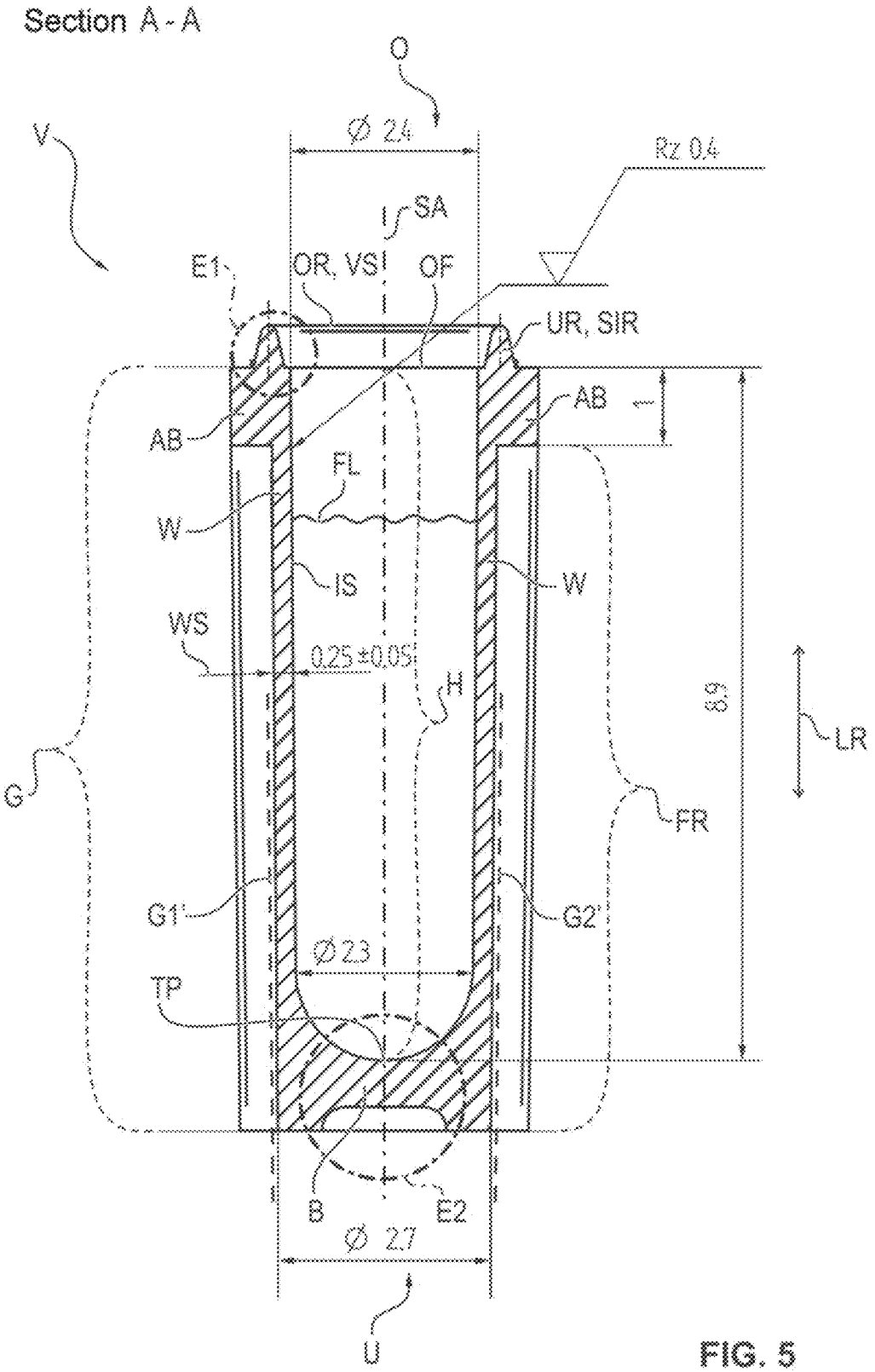
FIG. 5 shows a sectional view of the preferred embodiment of the storage vessel.
Figure 6:
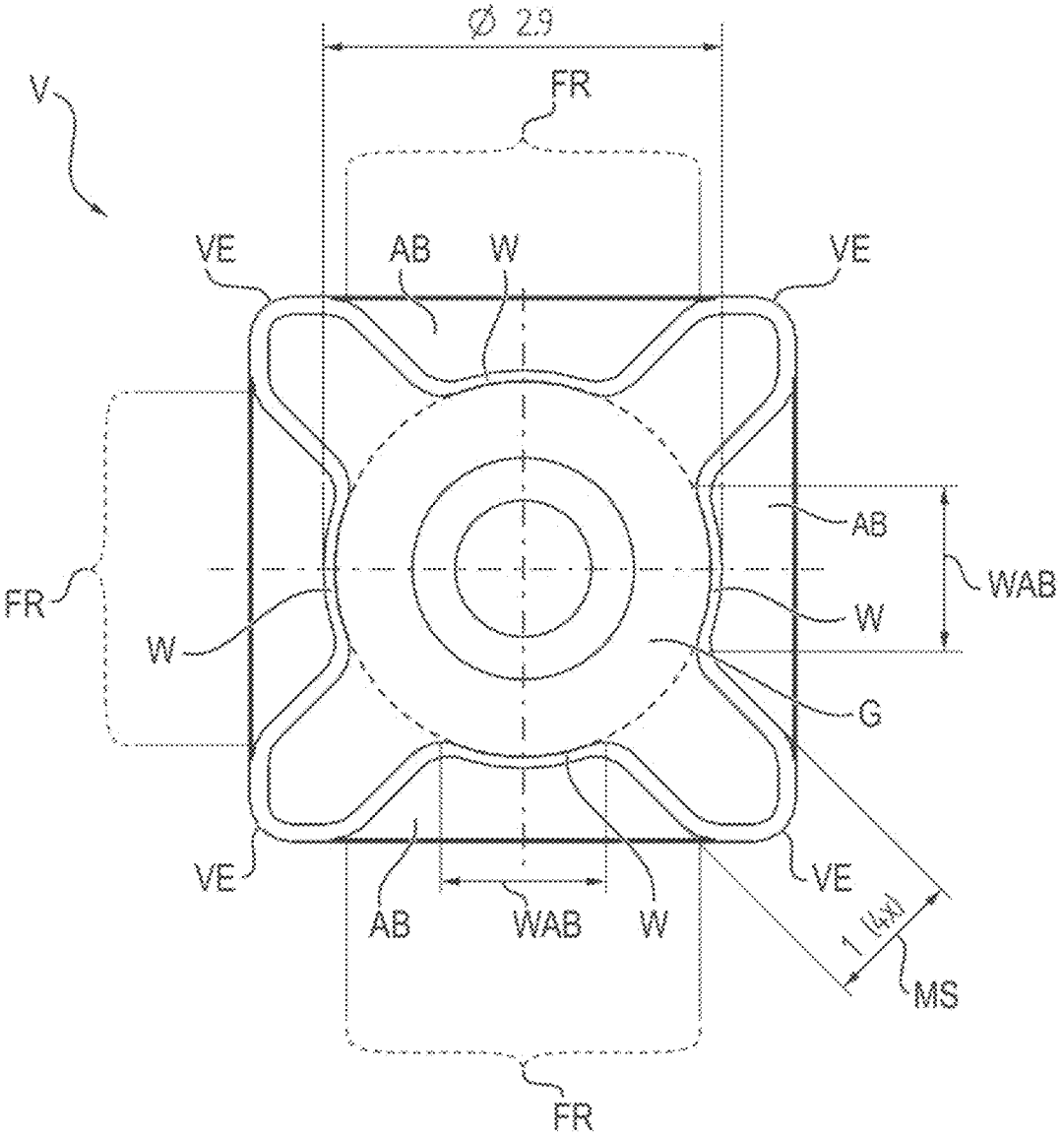
FIG. 6 shows a view of the preferred embodiment of the storage vessel from below.
Figure 7:
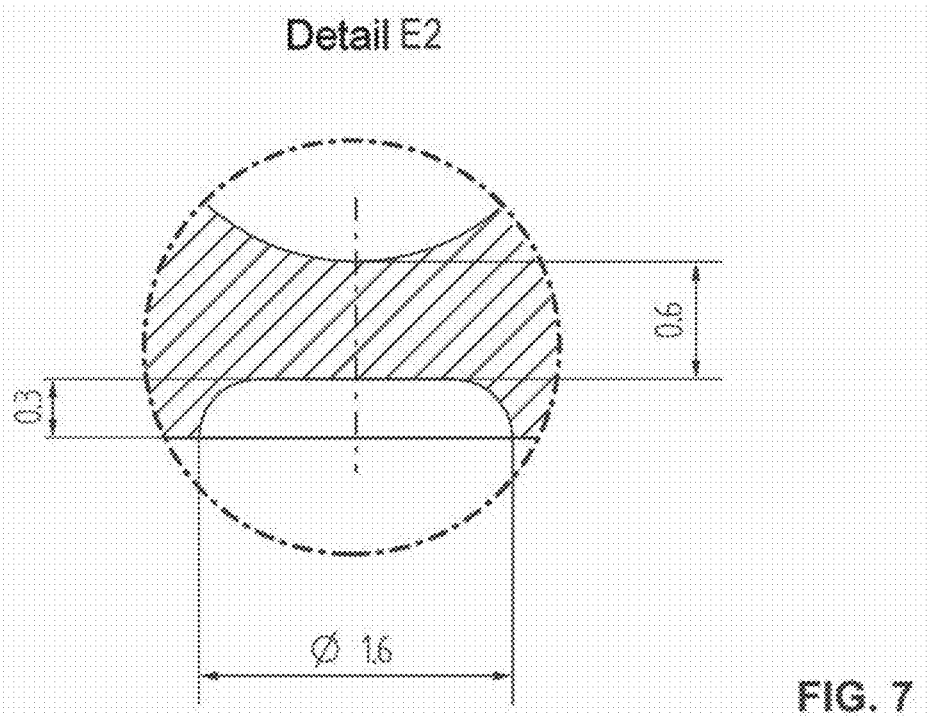
FIG. 7 shows a detail illustration of the base of the preferred embodiment of the storage vessel.
Figure 8:
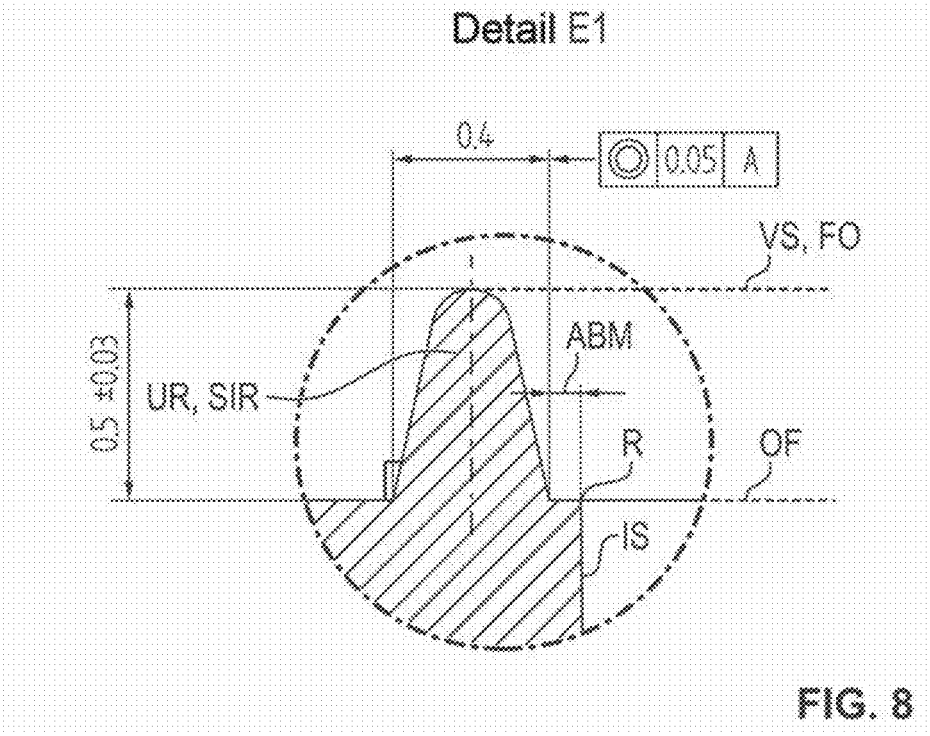
FIG. 8 shows a detail illustration of a border of an opening of the storage vessel according to the invention.
Figure 9:
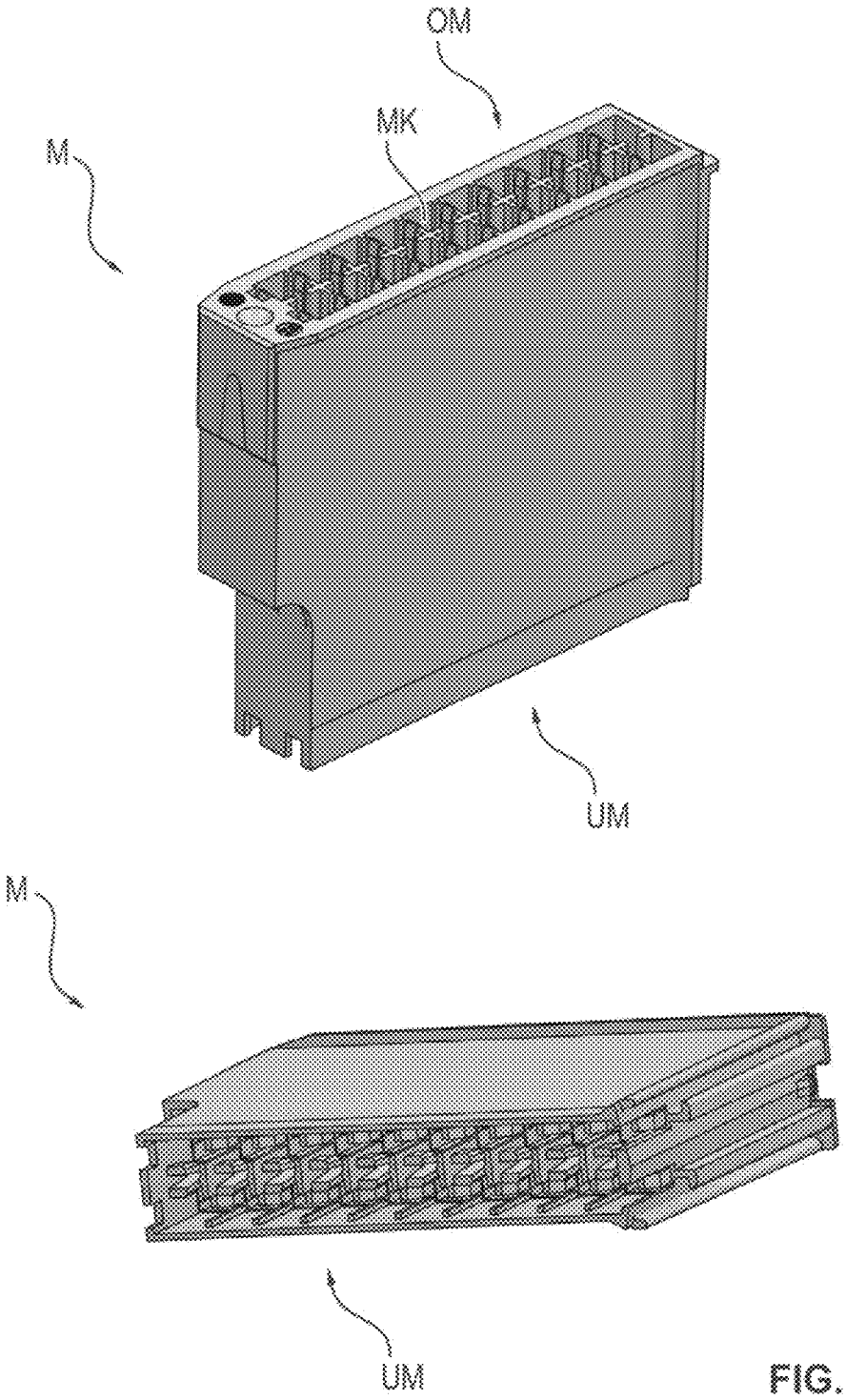
FIG. 9 shows an embodiment of a proposed magazine from two views.
Figure 10:
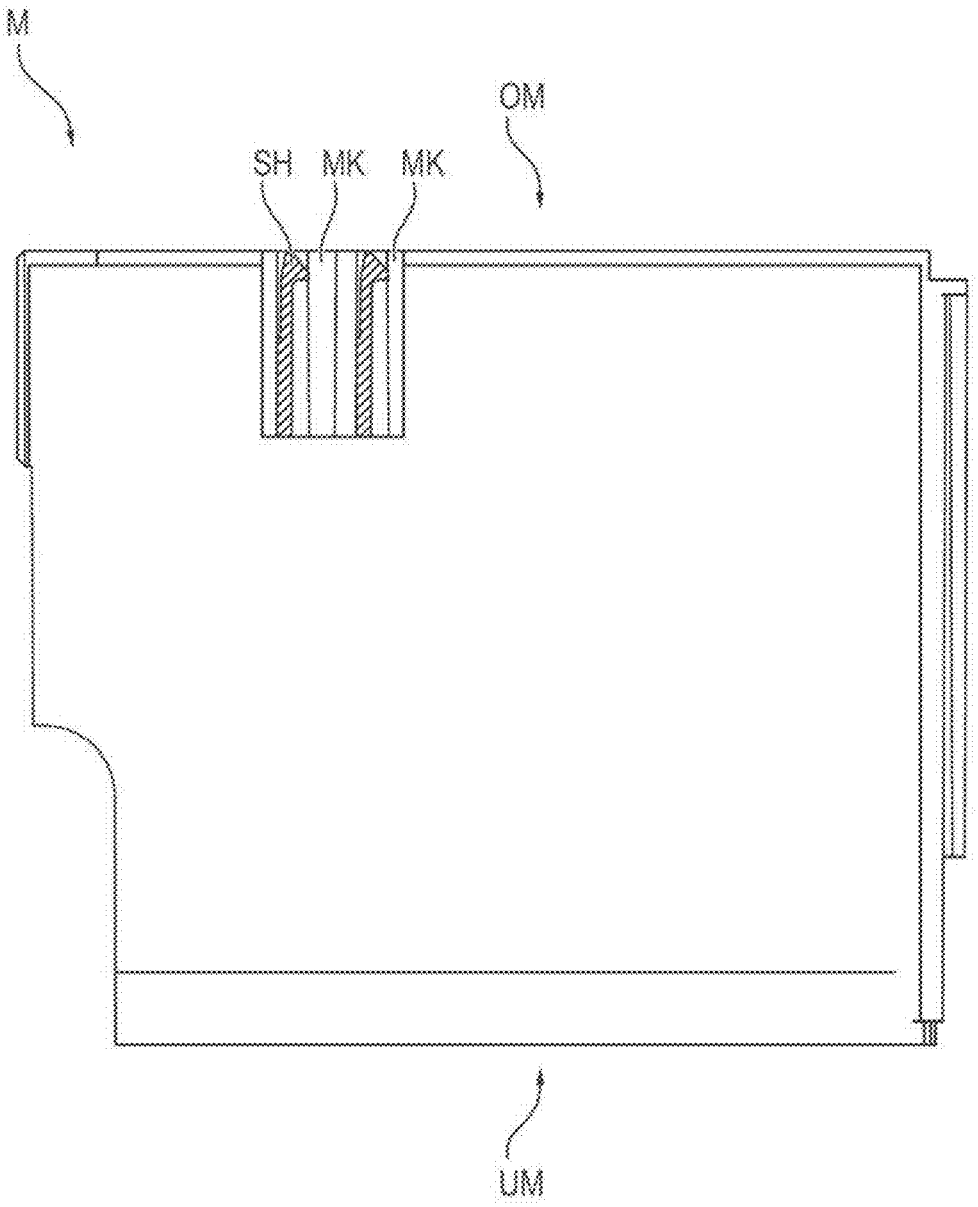
FIG. 10 shows a side view of the embodiment of the proposed magazine.
Figure 11C:
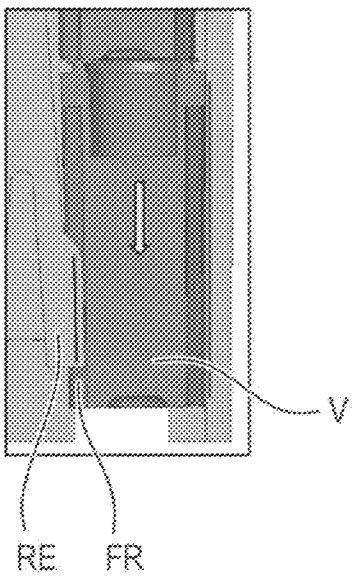
FIGS. 11*a*, 11*b*, and 11*c* show a storage vessel in a magazine channel in a first position.
Figure 11B:
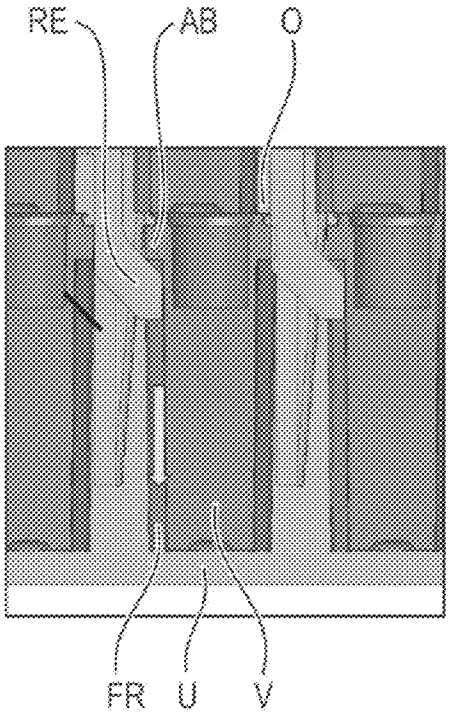
Figure 11A:
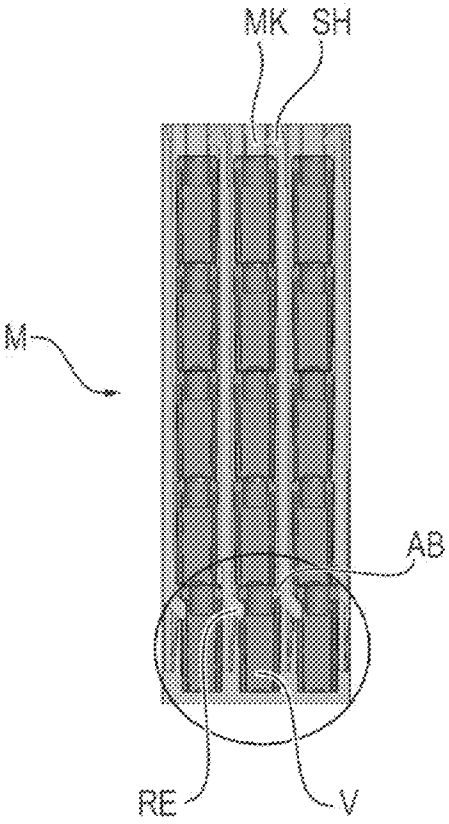
Figure 12:
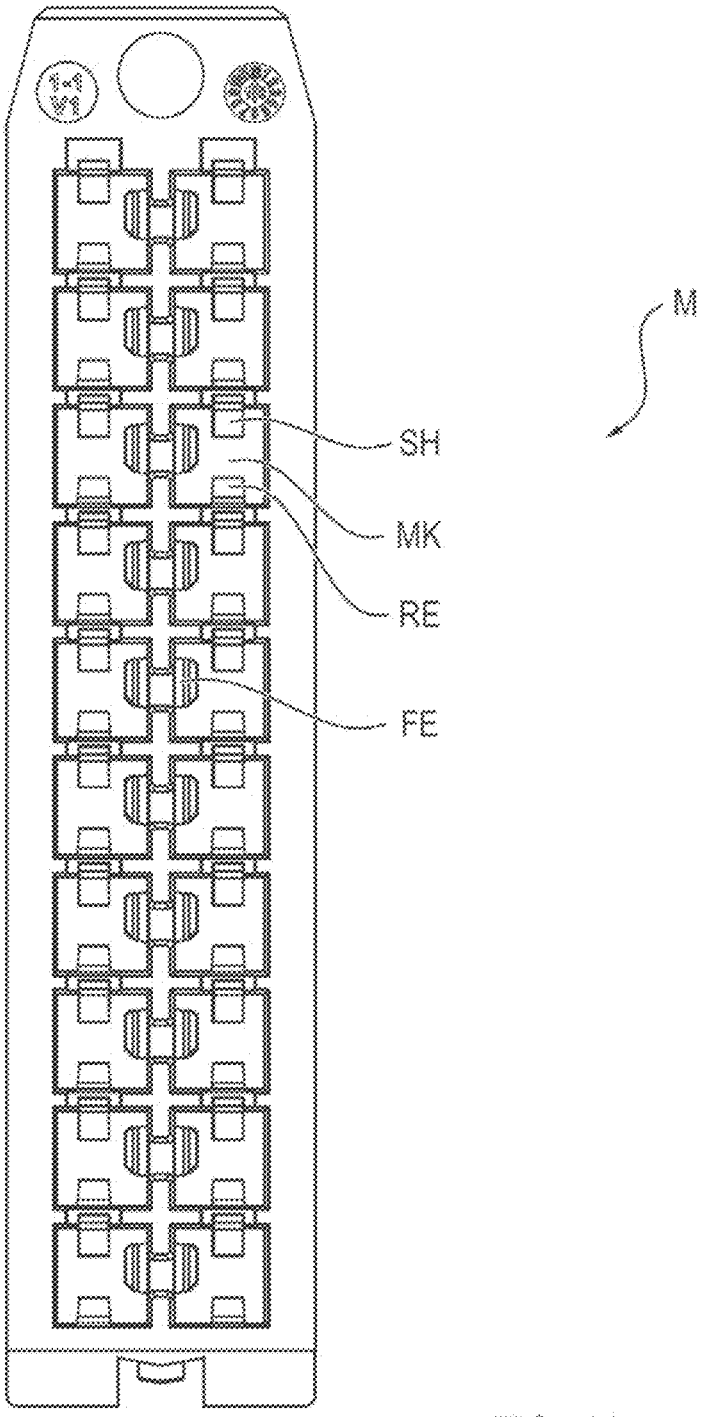
FIG. 12 shows a top view from above of the embodiment of the proposed magazine.
Figure 13:
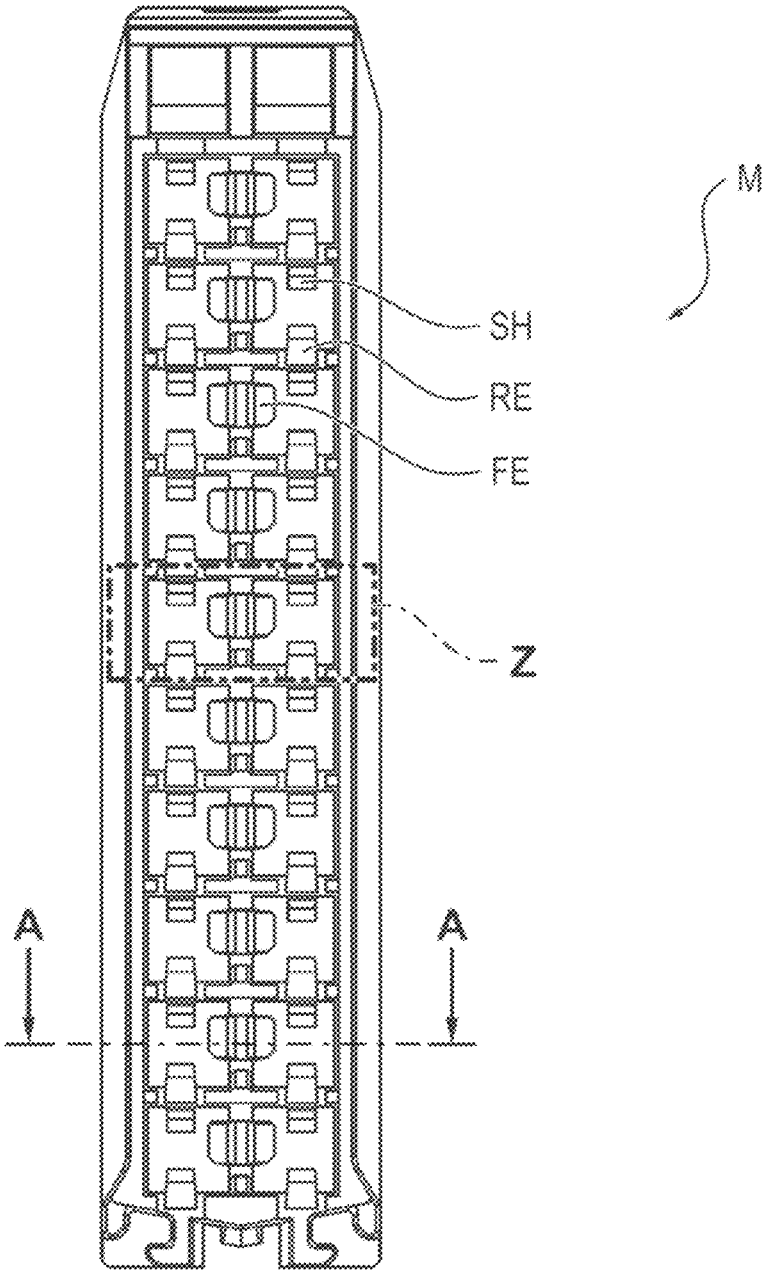
FIG. 13 shows a view from below of the embodiment of the proposed magazine.
Figure 14:
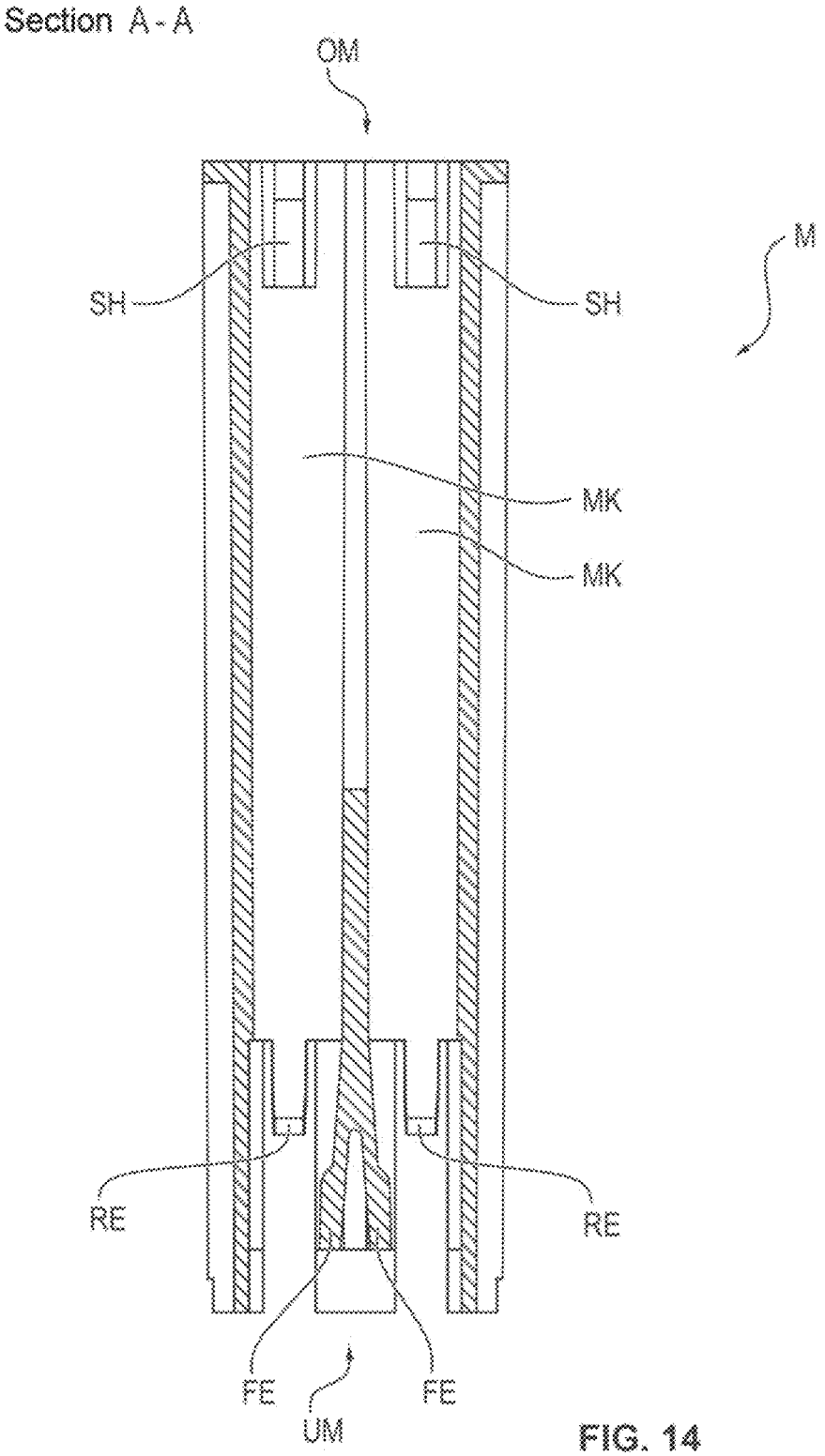
FIG. 14 shows a sectional view through magazine channels of the embodiment of the proposed magazine.
Figure 15:
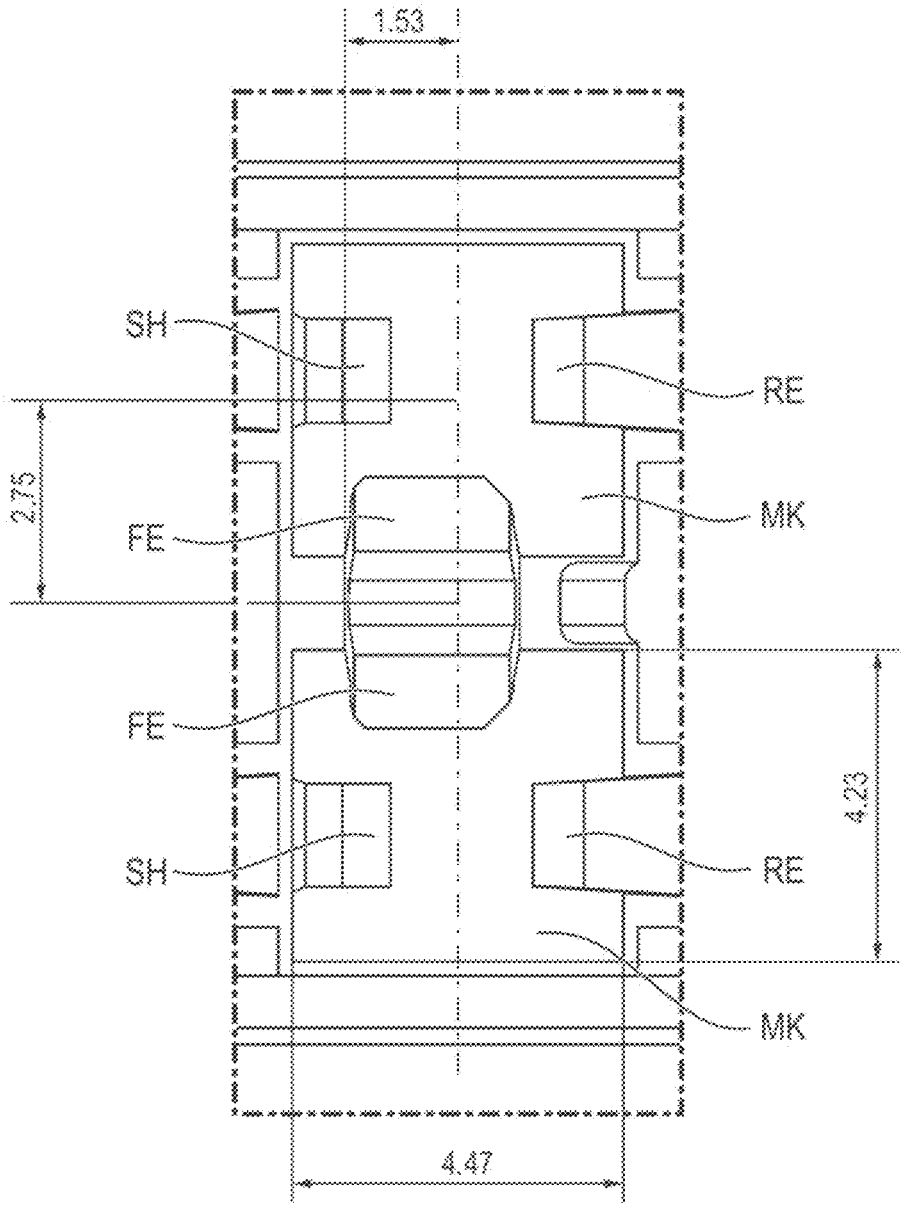
FIG. 15 shows details of magazine channels.
Figures 16A, 16B, 16C:
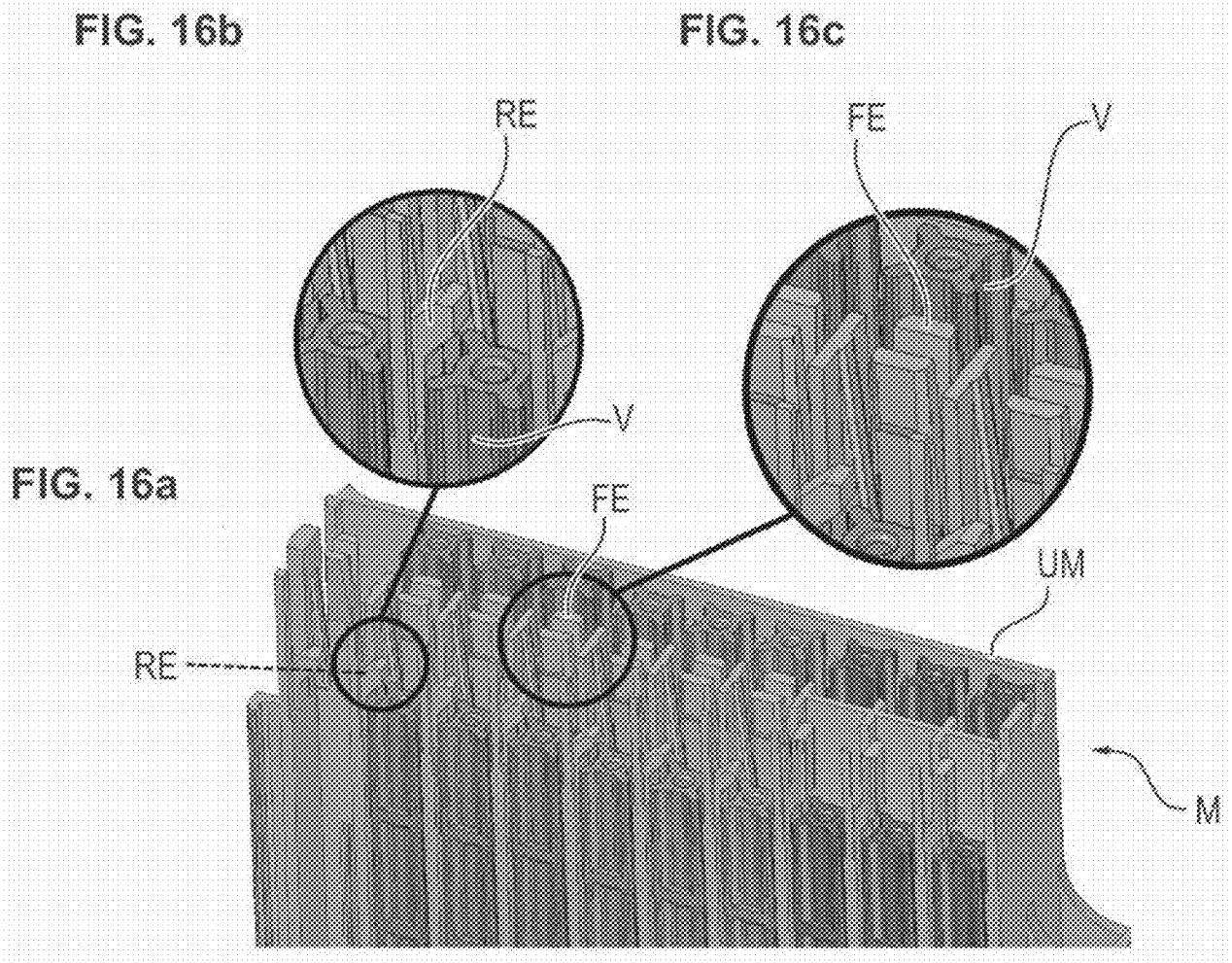
FIGS. 16*a*, 16*b*, and 16*c* show details of a magazine channel in a view of the embodiment of the proposed magazine obliquely from below.
Figure 17B:
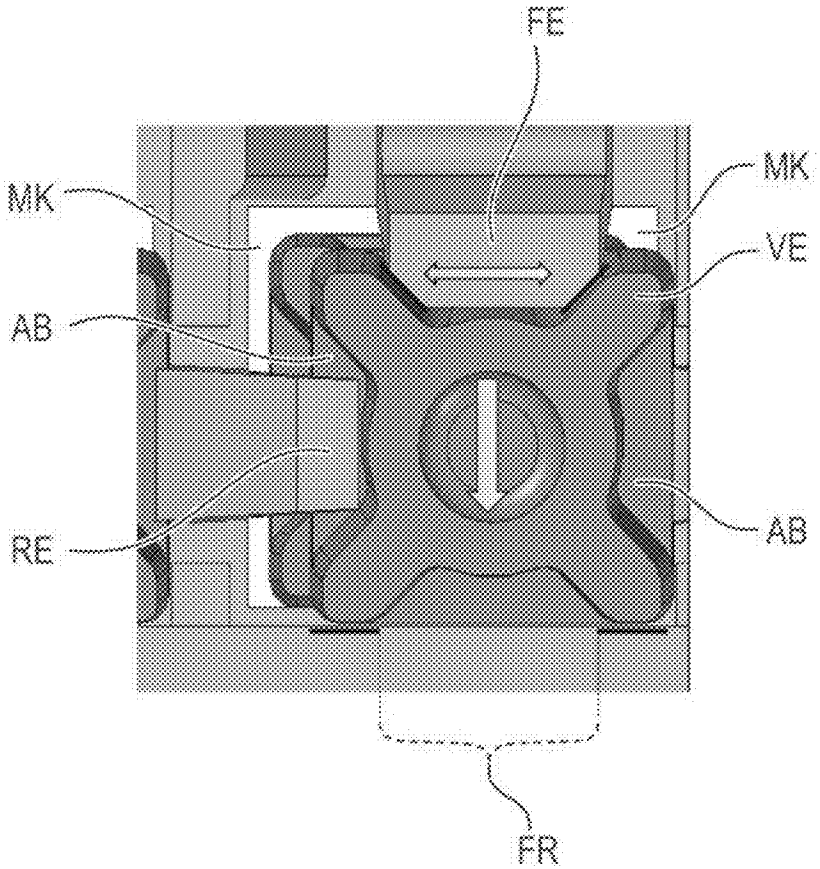
FIGS. 17*a* and 17*b* show details of a magazine channel in a view of the embodiment of the proposed magazine directly from below.
Figure 17A:
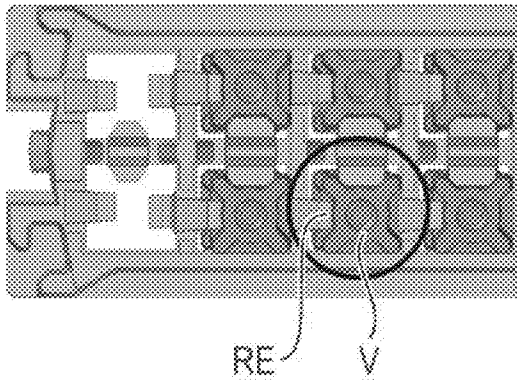

Without restricting the general concept of the invention, the invention will be discussed in more detail below on the basis of specific embodiments with reference to the figures. in which:

FIG. 1 shows a basic principle for flushing a liquid out of a storage vessel, as is known from the related art, FIG. 2 shows a preferred embodiment of a storage vessel according to the invention in a side position, FIG. 3 shows the preferred embodiment of the storage vessel according to the invention in an upright position in a side view, FIG. 4 shows the preferred embodiment of the storage vessel in a top view from above, FIG. 5 shows a sectional view of the preferred embodiment of the storage vessel, FIG. 6 shows a view of the preferred embodiment of the storage vessel from below, FIG. 7 shows a detail illustration of the base of the preferred embodiment of the storage vessel, FIG. 8 shows a detail illustration of a border of an opening of the storage vessel according to the invention, FIG. 9 shows an embodiment of a proposed magazine from two views, FIG. 10 shows a side view of the embodiment of the proposed magazine, FIGS. 11*a* to 11*c* show a storage vessel in a magazine channel in a first position, FIG. 12 shows a top view from above of the embodiment of the proposed magazine, FIG. 13 shows a view from below of the embodiment of the proposed magazine, FIG. 14 shows a sectional view through magazine channels of the embodiment of the proposed magazine, FIG. 15 shows details of magazine channels, FIGS. 16*a* to 16*c* show details of a magazine channel in a view of the embodiment of the proposed magazine obliquely from below, FIGS. 17*a* and 17*b* show details of a magazine channel in a view of the embodiment of the proposed magazine directly from below.

FIGS. 18 to 21 show, from different views or perspectives, a storage vessel in different positions in a magazine channel of the embodiment of the proposed magazine in a sectional view of the magazine channel.

FIG. 1 shows the basic principle known from the related art in which a flushing liquid SF is introduced, preferably via a pump P, by means of a tube S1 and a hollow needle N1, inserted into a storage vessel V, from a flushing reservoir SR into the storage vessel. By way of the flushing liquid SG, a liquid FL already present in the storage vessel V is flushed out via a further hollow needle N2 and a further tube S2 towards a reagent vessel RG. Ideally, after completion of such a rinsing process, the entire liquid FL has been flushed out of the storage vessel V and is situated in the reagent vessel RG. Here, the insertion of the hollow needles is realized in a pressure-tight manner.

FIG. 2 shows a preferred embodiment of a storage vessel V which contains a liquid. The liquid FL is illustrated in detail in FIG. 5.

In FIG. 2, the storage vessel V is situated in a side position. The storage vessel V has wall sections W of a main body G and reinforcement elements VE which bear against the main body G.

The main body G has an opening OF which is delimited towards the top by an encircling border UR.

The storage vessel V is preferably produced in one piece, particularly preferably by means of an injection moulding process or a 3D printing process. In the case of an injection moulding process, the storage vessel V is preferably produced from polyethylene, particularly preferably from high-density polyethylene.

In the case that the main body G and the reinforcement elements VE are produced in one piece by means of an injection moulding process, the wall sections W have no separating seams and also no sprue residues.

FIG. 3 shows the storage vessel V once again, in an upright position.

FIG. 4 illustrates the storage vessel V from the top side thereof. So-called grip elements G1, G2, which are able to be brought up to the storage vessel V from corresponding directions R1, R2 for the gripping of the storage vessel V, are schematically illustrated. Owing to the rotational symmetry of the storage vessel V and also to the rotationally symmetrical arrangement of the reinforcement elements VE, seen more clearly in FIG. 2, gripping of the storage vessel V is possible in different positions. In this exemplary embodiment, the storage vessel V has four reinforcement elements VE, and so, as can be seen in FIG. 4, the result is four different positions, in relation to a rotation of the storage vessel about the axis centre point MP of the axis of symmetry of the storage vessel, or of the axis of symmetry of the main body, in which the storage vessel V can be gripped in an identical manner. In the course of an automated process, it is therefore not necessary for the storage vessel V to be uniquely oriented in a single position in relation to a rotation about the centre point MP of the axis of symmetry of the storage vessel, or of the axis of symmetry of the main body, it being sufficient merely for said storage vessel to assume one of multiple positions in which the storage vessel can be gripped by the grip elements G1, G2 in an identical manner. The storage vessel, in relation to its axis of symmetry, is therefore rotationally symmetrical by an angle which is 360° divided by the number of reinforcement elements. The reinforcement elements VE are preferably elongated ribs having a material thickness which is greater than a wall thickness or material thickness of the wall sections W at least by a factor of 2.

FIG. 5 shows the storage vessel in a sectional view along an axis between the points A from FIG. 3.

The storage vessel V has a section which forms a main body G, against which the reinforcement elements VE from FIG. 2 bear.

The main body G is rotationally symmetrical in relation to the axis of symmetry SA.

The main body G forms, at least partially or at least sectionally, a rotationally symmetrical hollow space H into which the liquid FL is received at least partially or substantially, in particular the greatest part thereof is received. The hollow space H is preferably a circular-cylindrical or conical-cylindrical hollow space.

The main body G is terminated at its bottom side U by a base B. and, at its top side O, the main body G has an opening OF. The opening is closed off in a pressure-tight manner, in particular indirectly, by a closure VS, since the closure VS is attached to a border UR of the opening OF.

The closure VS is preferably a cover composed of plastic or aluminium. Preferably, the closure VS is a film, in particular comprising an aluminium film, particularly preferably in the form of an aluminium film for melting onto plastic, such as for example the border UR. The foil VS is preferably a multi-layered film having a first film layer composed of aluminium, a subsequent adhesive polyurethane-based film layer and a further subsequent film layer comprising linear low-density polyethylene (LLDPE).

The wall sections W have an equal wall thickness WS, which is preferably between 0.2 and 0.3 mm.

Returning to FIG. 2, it can be established once again that the reinforcement elements VE are arranged on the main body G such that, in each case between adjacent reinforcement elements VE, respective wall sections W of the main body G that are exposed externally are formed. The composition of the exposed wall sections W permits a pressure-tight insertion by at least two hollow needles.

FIG. 5 furthermore illustrates that the main body G is terminated at its bottom side U by the base B. The base B is, in a more precise manner, illustrated once again in the detail E2 in FIG. 7, from which it also emerges that the lowest point TP of the base B is curved, in particular upwardly curved, towards the inner wall I, illustrated in FIG. 5.

At the bottom side U, the main body has a recess AN, at which it is possible to tolerate for example material artefacts, such as for example sprue residues, such that, below the bottom side plane UE, no material projects downwardly beyond said bottom side plane UE. This ensures that, in the case of stacking of multiple storage vessels V one on top the other, such a material artefact from an injection moulding process, does not cause damage to a film or a closure of a downwardly adjacent storage vessel, in particular in the case that the storage vessels are stacked one on top of the other in an upright position.

The inner side IS of the main body also has a substantially constant surface roughness, in particular an average roughness depth of less than 0.8 Rz, particularly preferably of less than 0.5 Rz, very particularly preferably of 0.4 Rz.

FIG. 5 also shows two grip elements G1' and G2', which preferably engage into the guide grooves FR for the purpose of holding the storage vessel V.

FIG. 6 shows the storage vessel V from a bottom side, wherein the material thickness MS of the reinforcement element VE is illustrated, and in this case is for example 1 mm. As can be seen from FIG. 6, the respective wall sections W between two reinforcement elements VE delimiting a respective wall section W have a respective equal wall width WAB, in particular in a plane which is perpendicular to the axis of symmetry or longitudinal axis of symmetry of the main body.

FIG. 8 shows the detail E1 from FIG. 5. The opening OF is bordered, or outwardly framed, by a border UR or a corresponding seal boundary SIR. The border UR is preferably a so-called seal boundary SIR on which a film can be sealed by means of a melting process, such that the film can then serve as a closure of the storage vessel. Said border UR or the crater-like boundary UR serves for the attachment of a closure in the form of a film VS, FO by means of melting onto the boundary U or crater-like boundary U.

Said border UR or the seal boundary SIR is spaced apart by a spacing ABM from an outer edge R of the opening OF. Said spacing ABM is preferably 0.01 mm in size, particularly preferably at least 0.05 mm in size.

The closure VS is preferably a cover composed of plastic or aluminium, even more preferably in the form of a film. The film is preferably a plastic film or an aluminium film. The thickness of the film may be 5 μm to 5 mm, preferably 10 μm to 1 mm, even more preferably 25 μm to 250 μm. The foil VS is preferably a multi-layered film having a first film layer composed of aluminium, a subsequent second adhesive polyurethane-based film layer and a further subsequent third film layer comprising linear low-density polyethylene (LLDPE). The first film layer preferably has a thickness of 35 micrometres. The second film layer preferably has a density of 4 grams/square metre. The third film layer preferably has a thickness of 23 micrometres.

In a first preferred embodiment of the first aspect, the storage vessel has an inner height H, and the inner base thereof has a diameter D, and the ratio of D to H is at least 1:2, more preferably 1:5, even more preferably 1:10.

The storage vessel has a base or inner base and an inner height H, the base which is geometrically accessible to the contained liquid and the height of the side wall accessible to the liquid being understood here. Preferably, the vessel has the largest possible ratio of inner height to inner base, measured in the form of the inner diameter D thereof, thus resulting in the smallest possible inner base surface for the absorption of sedimented substances on the base. The ratio of D to H is preferably at least 1:2, 1:2.5, 1:3, 1:4, 1:5, 1:7.5, 1:10, 1:15 or 1:20, wherein the longitudinal axis extends along the longer side and has two ends. The top side is situated at one of the ends. The top side is preferably at the end which, for the orientation during use of the storage vessel, which orientation is predefined by the shape of the storage vessel, is situated at the top.

The main body has such a composition that, in particular in the region of the exposed wall sections, it permits the pressure-tight insertion of two hollow needles, the latter preferably being ground high-grade tube sections. Preferably, the outer diameter thereof is 0.5 to 5 mm, particularly preferably 1 mm, and the inner diameter thereof is 0.1 to 3 mm, particularly preferably 0.2 to 0.7 mm, with the condition that the inner diameter is smaller than the outer diameter, which is preferably 0.4 mm. In particular, a hollow needle has in each case one fixed, closed-off tip for penetrating through the wall section and also has a diameter of 1 mm. Two lateral openings, preferably opposite one another, are in particular situated in the outer wall of the hollow needle. Each opening preferably has a circular cross-sectional surface with a diameter which preferably lies in the range of 0.2 to 0.3 mm, particular preferably is 0.28 mm.

In a preferred embodiment, the storage vessel is deemed to be pressure-tight if the introduction of 1 ml of water into the completely filled storage vessel over 100 seconds via a hollow needle, which is inserted in a pressure-tight manner, brings about the exit of less than 750, more preferably 950, even more preferably 990 μl of water over the same period of time via a second hollow needle of the same type, which is inserted in a pressure-tight manner. The insertion is preferably deemed to be of pressure-tight form if, when closing off the inserted hollow needle, the storage vessel remains pressure-tight. The diameter of the hollow needles has to be of such a size that any solids contained in the liquid, such as beads, cannot block the needles.

Preferably, one embodiment of the two hollow needles is in the form of a double needle, in the case of which both needles are connected with the same orientation, with an arrangement which is parallel at least over the longitudinal axis, for example by soldering together of two metal hollow needles, or in the form of a coaxial needle. In the latter case, the first hollow needle has a smaller diameter than the second hollow needle and is arranged concentrically in the interior thereof, wherein the first hollow needle is longer than the second and projects from the outlet opening thereof to such an extent that no short-circuiting occurs. If the first and second hollow needles are connected to one another with a parallel arrangement and identical orientation, then they may advantageously be inserted together into the storage vessel.

As can be seen in FIG. 2, the reinforcement elements VE and the main body G extend as far as the bottom side U of the storage vessel V. In this way, the reinforcement elements VE form, together with the main body G, guide grooves FR, which are open towards the bottom side U of the main body G. Said guide grooves FR are entered or drawn once again in FIG. 5, and also in FIG. 6.

The storage vessel from FIG. 2 has at its top side O a shoulder AB which delimits the guide grooves FR towards the top. Said shoulder can also be seen clearly once again in FIG. 5. In FIG. 6, in which the storage vessel is shown from its bottom side, the view of the observer is directed directly at the bottom side of the shoulder AB.

The guide grooves FR are freely accessible from the bottom side U of the main body G.

The shoulder ABL is situated at the top side of the storage vessel at the height of the opening OF of the storage vessel V.

The shoulder ABL from FIGS. 6, 5 and 2 delimits the guide grooves FR towards the top or terminates them.

The reinforcement elements VE are preferably elongated ribs which run from the bottom side of the storage vessel as far as the shoulder at the top side of the storage vessel. The reinforcement elements VE do not project beyond a base surface of the top side of the storage vessel, in particular as viewed from above onto the top side of the storage vessel, as can be seen from the top view in FIG. 4.

Owing to the guide grooves proposed here, it is possible to guide the storage vessel through at least one guide element, as will be described in detail precisely below.

FIG. 9 shows an oblique view of a proposed magazine M, which has at least one magazine channel MK.

The magazine channel MK is accessible from the top side OM of the magazine and also from the bottom side UM of the magazine.

FIG. 10 shows the magazine M in a side view in which two magazine channels MK are visible owing to part of a side wall being visually removed. A magazine M preferably has a mechanically flexible or elastically deformable snap-action hook SH in the upper region of the magazine channel, via which a supply of storage vessels into a magazine channel MK can be controlled. The snap-action hook SH retains storage vessels situated in the magazine channel MK, in particular for the case in which the magazine M is held with its top side downward.

FIG. 12 shows a top view of the magazine M from above, in which the snap-action hook SH is also visible in the region of the magazine channel.

FIG. 13 shows the magazine M from a bottom side. The snap-action hook SH is also visible from the bottom through the magazine channel MK. Furthermore, a retaining element or a detent element RE and a guide element FE are visible.

FIG. 14 shows the magazine channel MK once again in a sectional view of a section A-A from FIG. 13. In FIG. 14, the guide element FE and the detent element RE at the bottom side UM of the channel MK or of the magazine M are also visible. The magazine channel MK extends in a straight manner through the magazine M.

FIG. 11*a* shows a magazine M having multiple storage vessels V in a magazine channel MK. Here, a bottommost storage vessel V is retained in the magazine MK by a retaining element RE. From FIG. 11*a* together with FIG. 11*b*, which illustrates the vessel V in enlarged form, it can be seen that the mechanically flexible retaining element RE, in its rest position, engages into the magazine channel MK. In this first position, the shoulder AB of the storage vessel V comes to bear against the retaining element RE.

FIG. 11*c* shows the storage vessel V in the same first position in a side view of the magazine from a perspective, which, in comparison with the perspective of FIG. 11*b*, is rotated through 90° about the axis of symmetry of the magazine channel or through 90° about the axis of symmetry of the storage vessel V. Preferably, in the first position shown here of the storage vessel V, the retaining element RE engages into one of the guide grooves FR.

In the first position, the storage vessel V, in particular despite its weight force, is retained in the magazine channel MK by the retaining element RE, in particular such that the storage vessel V, in the first position, does not project with its bottom side U from the magazine channel MK.

If a force is exerted on or applied to the top side O of the storage vessel, then the retaining element RE is deflected by the shoulder AB. In particular, the retaining element RE is deflected at least partially from the magazine channel MK such that the shoulder can pass the receiving region, or the storage vessel V can pass the retaining element RE, as is then drawn in a further position in FIG. 19*a*.

Figure 19B:
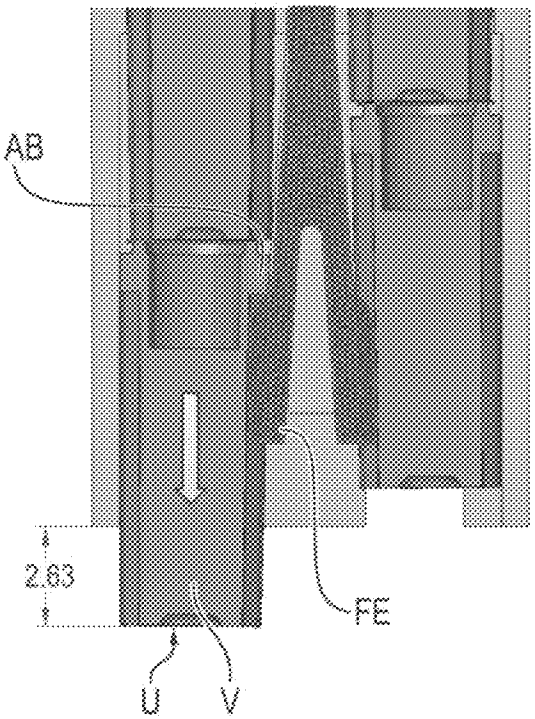
FIGS. 19*a* and 19*b* show perspectives of a storage vessel in different positions in a magazine channel of the embodiment of the proposed magazine in a sectional view of the magazine channel.
Figure 19A:
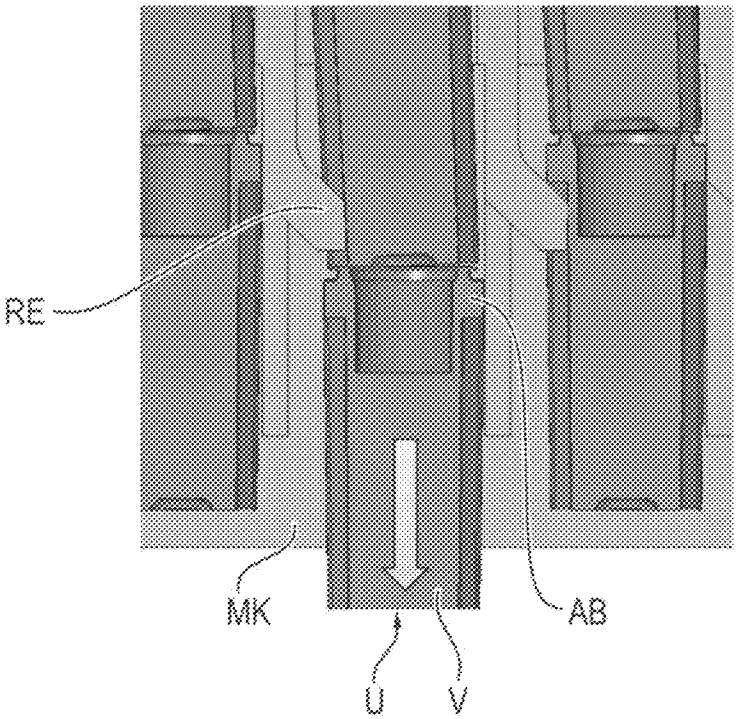

The retaining element RE returns to its rest position after the passing of the shoulder AB, as is shown in FIG. 19*a*.

FIG. 15 shows a detail Z from FIG. 13, in which the position of the retaining element RE can, in a more precise manner, be seen once again.

The bringing-out or forcing-out of a storage vessel from the magazine channel gives rise to interaction of the retaining element RE and the guide element FE in a particular manner, as is now described below.

FIG. 17*a* shows a magazine M with storage vessels V situated therein, wherein the retaining element RE and also the guide element FE can be seen from the bottom side. FIG. 17*b* shows an enlargement of this view for a sub-region.

FIG. 16*a* shows the magazine M with storage vessels V once again from the bottom side UM of the magazine, wherein, in FIG. 16*b*, the retaining element RE is illustrated once again for an enlarged region and, in FIG. 16*c*, the guide element FE is illustrated once again for an enlarged region. The guide element FE can also be clearly seen in FIGS. 15 and 14.

Since the guide element FE and the retaining element RE are situated at different sides of the magazine channel MK, as can be seen from FIG. 15, interaction of the guide element FE and of the retaining element RE with the storage vessel is the result. The interaction of the guide element FE and of the retaining element RE with the storage vessel will now be discussed with reference to FIGS. 18 to 21, using in each case two views or perspectives for respective positions of the storage vessel.

The two views or perspectives are, with respect to one another, rotated through 90° about the axis of symmetry of the magazine channel or through 90° about the axis of symmetry of the storage vessel V.

The guide element FE is provided in the lower region of the magazine channel MK at a second height H2, below the first height H1 of the retaining element RE, as can be clearly seen from FIG. 18*a* and B.

Figure 18B:
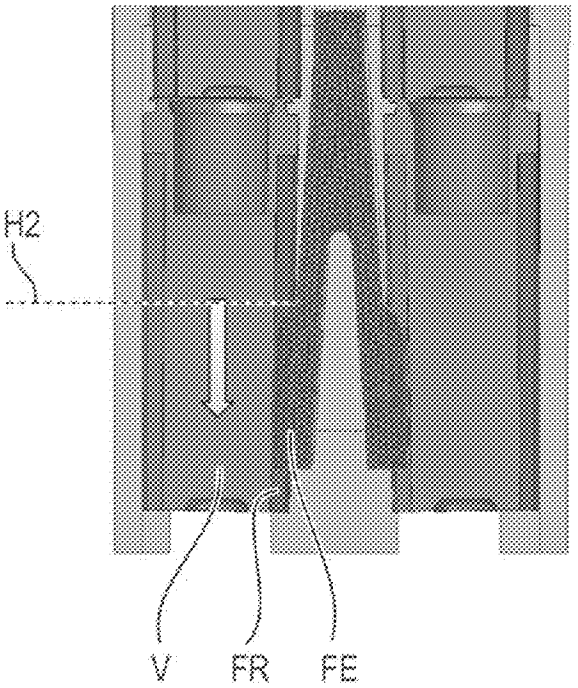
FIG. 18*b* shows a sectional view in the case of the storage vessel having been rotated through 90° about the axis of symmetry, in which the guide element FE can be seen.
Figure 18A:
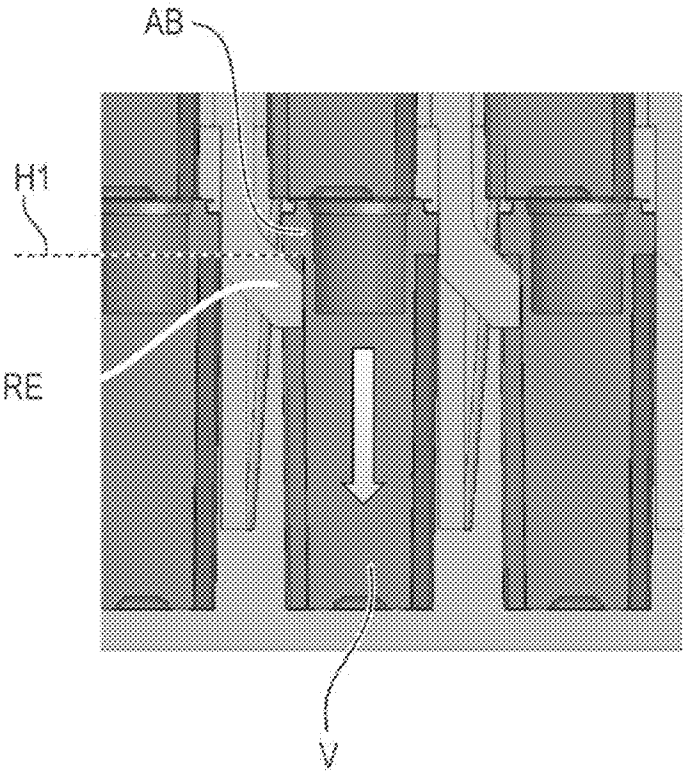
FIG. 18*a* shows a sectional view in which the retaining element RE can be seen in a first position.

FIG. 18*a* shows a sectional view in which the retaining element RE can be seen in a first position, while a corresponding view from FIG. 18*b* shows a sectional view in the case of the storage vessel having been rotated through 90° about the axis of symmetry, in which the guide element FE can be seen. The guide element FE is a mechanically flexible guide element.

Preferably, the guide element FE already engages, in the first position of the storage vessel V from FIGS. 18*a* and 18*b*, into one of the guide grooves FR.

As can be seen from FIG. 17*b*, the guide element FE bears against the reinforcement elements VE forming the guide groove FR. In this case, the guide element FE brings about an orientation of the storage vessel V in the magazine channel MK into a preferred position. In this way, it is therefore possible for the magazine channel MK, with consideration taken of a certain tolerance, to have greater dimensions than the cross section of the storage vessel V.

The cross-sectional surface of the magazine channel MK is larger than the cross-sectional surface of the storage vessel V. In this case, the cross-sectional surface of the storage vessel extends perpendicular to the axis of symmetry of the storage vessel in the longitudinal direction. The magazine channel MK has a cross-sectional surface which is dimensioned such that the storage vessel cannot be rotated through more than 5 degrees about its axis of symmetry or longitudinal axis of symmetry. The magazine channel MK furthermore has a cross-sectional surface which is dimensioned such that the storage vessel or its longitudinal axis of symmetry cannot be tilted by more than 5 degrees with respect to the magazine channel MK.

FIGS. 19*a* and 19*b* show the storage channel in a second position, in which the storage vessel V projects with its bottom side U from the magazine channel MK.

In said second position, as can be seen in FIG. 19*a*, the shoulder AB of the storage vessel V has already passed the retaining element RE.

As can be seen from FIG. 19*b*, in the second position, the guide element FE bears against the shoulder AB.

The fact that, in the second position, the storage vessel V projects with its bottom side U from the magazine channel MK means that, in this way, the storage vessel is, at least by way of a sub-region, accessible to a gripping unit outside the magazine channel, with the result that such a gripping unit can then expect the storage vessel V at a defined location or in a defined position owing to the guidance by the guide element FE. This facilitates automated processing since gripping robots, for example, expect gripping of a storage vessel V always at a defined spatial location or position. A gripping unit can preferably then engage into the guide grooves by means of grip elements.

Figure 20B:
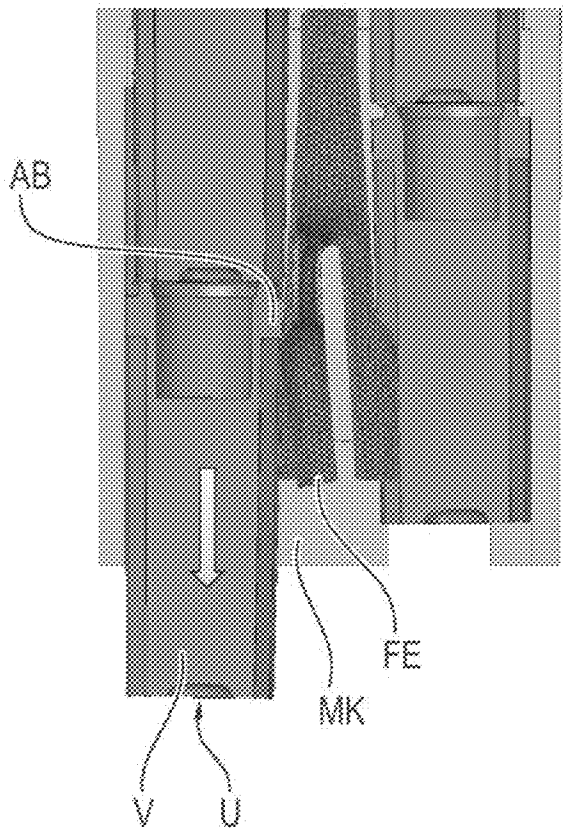
FIGS. 20*a* and 20*b* show perspectives of a storage vessel in different positions in a magazine channel of the embodiment of the proposed magazine in a sectional view of the magazine channel.
Figure 20A:
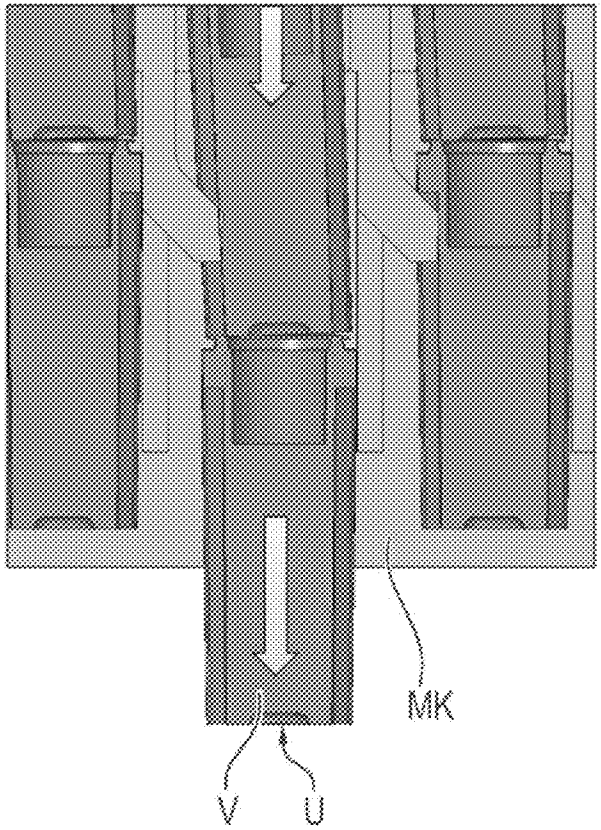
Figure 21:
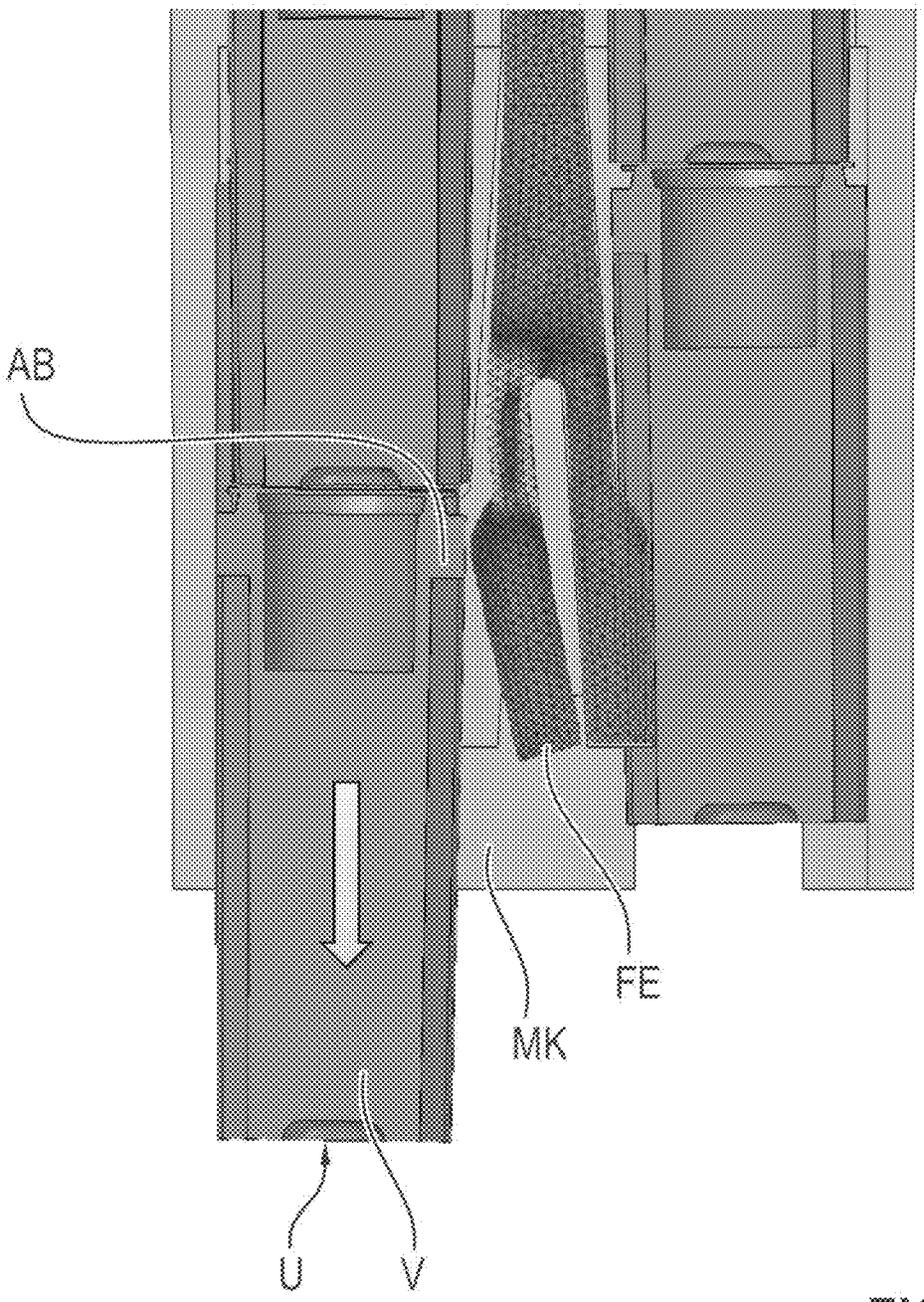
FIG. 21 shows a perspective of a storage vessel in different positions in a magazine channel of the embodiment of the proposed magazine in a sectional view of the magazine channel.

As can be seen from FIGS. 19*b* and 20*b* and 21, the guide element FE is deflected by a further application of force to the top side O of the storage vessel V and is deflected at least partially from the magazine channel.

Furthermore, the guide element FE is formed in particular such that, after the shoulder AB passes the guide element FE, the guide element FE returns to its rest position.

The combination of guide element FE and retaining element RE makes it possible firstly for the proposed magazine M to be able to be equipped with storage vessels V or a plurality of storage vessels V in a magazine channel, and also for the magazine M to be able to be set down, by way of its bottom side UM, for example on a table or some other possibility for placement without a storage vessel being damaged from its bottom side.

Since, when bringing the storage vessel, or forcing the storage vessel, out of the magazine channel MK, it is advantageous to bring the storage vessel V into an exact, defined spatial location, which cannot be ensured by a retaining element RE alone, it is advantageously achieved by the guide element FE that the storage vessel V projects from the magazine channel MK at the defined spatial location. Owing to the mechanical flexibility of the guide element FE, said guide element FE also returns to a rest position after performing its function for the spatial positioning of a storage vessel V, in which rest position it can engage into a guide groove FR of a further storage vessel V immediately or at a later stage. The result is therefore a particularly advantageous interaction of the guide grooves FR, formed by the reinforcement elements VE and the main body and open towards the bottom, of the storage vessels V and the guide element FE, and also the retaining element RE.

LIST OF REFERENCE SIGNS

V Vessel
FL Liquid
SA Axis of symmetry
G Main body
H Hollow space
U Bottom side
B Base
O Top side
OF Opening
VS Closure
VE Reinforcement element, reinforcement elements
W Wall sections
N1, N2 Hollow needles
MP Axis centre point
TP Point
IS Inner side
AM Recess
R Boundary MS Material thickness
WS Wall thickness
RG Reaction vessel
SR Flushing liquid reservoir
SF Flushing liquid

The invention claimed is:

1. A pressure-tight storage vessel containing a liquid, comprising:

an elongated main body which is rotationally symmetrical with respect to an axis of symmetry and which forms, at least sectionally, a rotationally symmetrical hollow space, in which a liquid is substantially received, wherein the elongated main body is terminated at a bottom side by a base, and has an opening at a top side which is closed off in a pressure-tight manner by a closure, and a plurality of reinforcement elements, which bears against the elongated main body at the outside, which extends parallel to said axis of symmetry, and which is arranged rotationally symmetrically about said axis of symmetry such that, in each case between adjacent reinforcement elements, respective externally exposed wall sections of the elongated main body are formed, wherein the composition of the externally exposed wall sections permits a pressure-tight insertion by at least two hollow needles, wherein the main body has no separating seam and no sprue residues on the externally exposed wall sections for the pressure-tight insertion by the at least two hollow needles, wherein the storage vessel has a border at the top side, wherein said border encircles the opening and which is spaced apart from an outer boundary of the opening, wherein the closure is an aluminum or plastic film attached to the border by melting, wherein the main body and the reinforcement elements comprises plastic and are produced in one piece from the plastic by an injection moulding process, wherein the main body has a recess at a bottom side of the elongated main body, and wherein the base is curved from the lowest point of the base extending to the inner wall of the main body, wherein the reinforcement elements and the elongated main body extend as far as the bottom side of the storage vessel, wherein the reinforcement elements form, together with the main body, guide grooves, which are open towards the bottom side of the elongated main body, and wherein the storage vessel has a shoulder at the top side, wherein the shoulder delimits the guide grooves towards the top side.

2. The storage vessel according to claim 1, wherein the respective externally exposed wall sections have a respectively equal wall thickness.

3. The storage vessel according to claim 1, wherein said plastic is polyethylene.

4. The storage vessel according to claim 1, wherein an inner side of the main body has a substantially constant surface roughness.

5. The storage vessel according to claim 1, wherein the wall thickness of the exposed wall sections is greater than 0.15 mm.

6. The storage vessel according to claim 1, wherein the liquid constitutes an inhomogeneous liquid phase.

7. The storage vessel according to claim 1, wherein the liquid constitutes a homogeneous liquid phase.

8. The storage vessel according to claim 1, wherein the elongated main body forms, at least sectionally or at least partially, a circular-cylindrical hollow space or a conical-cylindrical hollow space.

9. The storage vessel according to claim 4, wherein the substantially constant surface roughness has an average roughness depth of less than 0.8 Rz.

10. The storage vessel according to claim 5, wherein the wall thickness of the exposed wall sections is greater than 0.2 min.

11. The storage vessel according to claim 6, wherein the liquid comprises an aqueous solution comprising beads.

12. The storage vessel according to claim 7, wherein the liquid is at least one selected from the group consisting of a biological agent in an aqueous solution, a chemical agent in an aqueous solution, a liquid sample, a blood sample, and a serum.

13. The storage vessel according to claim 1, wherein the film of the closure comprises an aluminum or plastic film, having a thickness of 5 micrometers to 5 mm.

14. The storage vessel according to claim 13, wherein the film is a multi-layered film comprising an aluminum layer and a plastic layer.

15. A magazine for storing multiple storage vessels, comprising:

at least one of the storage vessel according to claim 1, and at least one magazine channel, which extends from a top side of the magazine as far as a bottom side of the magazine and into which the at least one storage vessel can be pushed, with the bottom side of the storage vessel first, from the top or the top side of the magazine, wherein, in a lower region of the at least one magazine channel, a mechanically flexible retaining element is located, which, in a rest position, projects into the at least one magazine channel, which is formed such that, in a first position of the storage vessel, the mechanically flexible retaining element engages into one of the guide grooves and also the shoulder of the storage vessel comes to bear against the mechanically flexible retaining element.

16. The magazine for storing multiple storage vessels according to claim 15, wherein, in the lower region of the magazine channel, at least in a second position of the storage vessel below the first position, the mechanically flexible guide element engages into one of the guide grooves and bears against the reinforcement elements forming the guide groove, wherein, in the second position, the storage vessel projects with its bottom side from the magazine channel.

17. A method for transferring a liquid from a storage vessel into a reaction vessel, comprising:

a) inserting, in a pressure-tight manner, a first hollow needle into the storage vessel according to claim 1, wherein said first hollow needle is connected to a flushing liquid reservoir, b) inserting, in a pressure-tight manner, a second hollow needle into the storage vessel, wherein said second hollow needle is connected to the reaction vessel, and c) introducing a flushing liquid via the first hollow needle from the flushing liquid reservoir into the storage vessel, with expulsion of the liquid via the second hollow needle from the storage vessel into the reaction vessel.

* * * * *